United States Patent [19]

Stevenson, IV

[11] 4,343,257

[45] Aug. 10, 1982

[54] WORKING SAILS AND METHODS FOR FURLING THEM WHILE ALOFT

[76] Inventor: William H. Stevenson, IV, Rte. 5, Box 532, Travelers Rest, Easton, Md. 21601

[21] Appl. No.: 139,105

[22] Filed: Apr. 10, 1980

[51] Int. Cl.[3] ..... B63H 9/10

[52] U.S. Cl. ..... 114/104; 150/1; 150/7

[58] Field of Search ..... 114/102–105; 150/1, 7; 160/349 D

[56] References Cited

U.S. PATENT DOCUMENTS

| | | | |
|---|---|---|---|
| 2,247,219 | 6/1941 | Childs | 114/104 |
| 2,251,512 | 8/1941 | Bush et al. | 160/349 D |
| 2,865,418 | 12/1958 | Bourdon | 150/1 |
| 3,147,729 | 9/1964 | Barnard | 114/103 |
| 3,157,149 | 11/1964 | Manchester, Jr. | 114/104 |
| 4,094,351 | 6/1978 | Catenaccio | 150/1 |
| 4,122,793 | 10/1978 | Molz | 114/106 |

*Primary Examiner*—Sherman D. Basinger

*Attorney, Agent, or Firm*—Roylance, Abrams, Berdo & Farley

[57] ABSTRACT

Working sails, typically headsails and mainsails, are furled while aloft by providing flexible sheet material extending along the sail from head to foot, at least preliminarily furling the sail from leech to luff, progressively forming the flexible sheet material into a tubular bag extending from head to foot and enclosing the furled sail, and progressively securing the bag against opening.

71 Claims, 36 Drawing Figures

FIG. 8
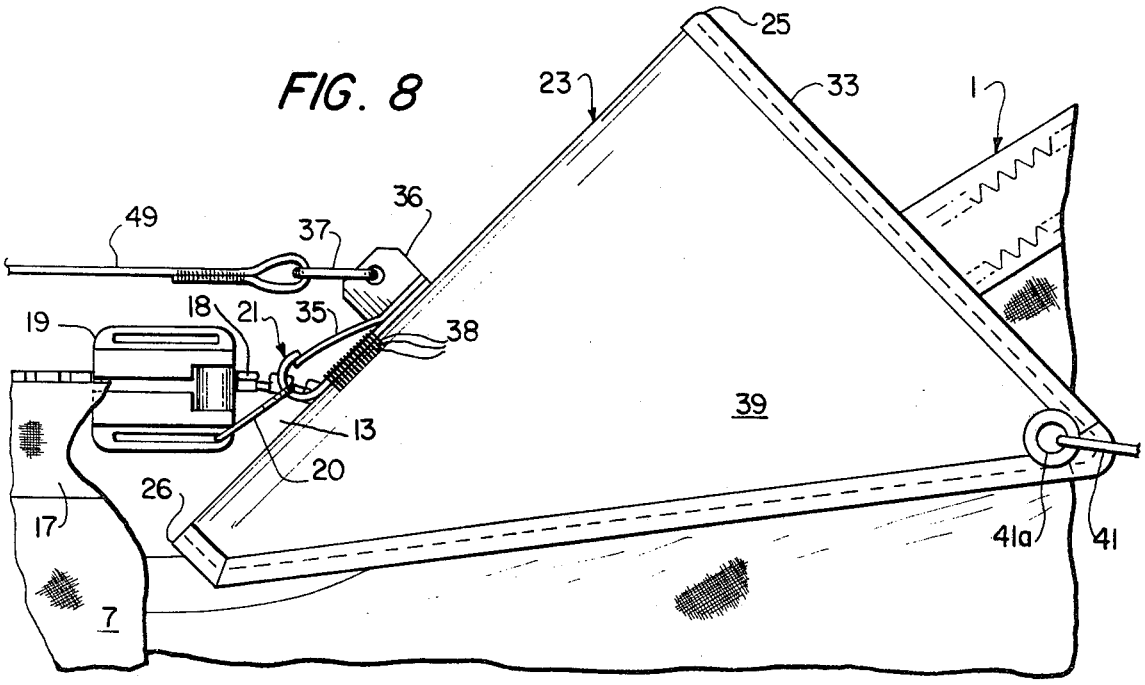
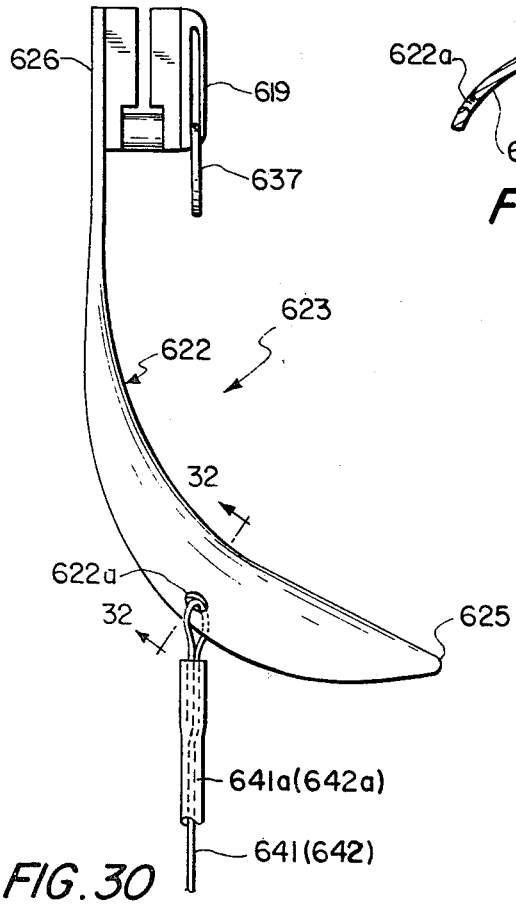
FIG. 30
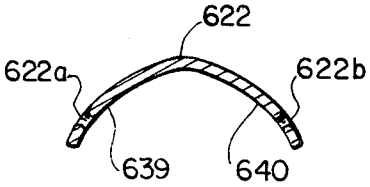
FIG. 32
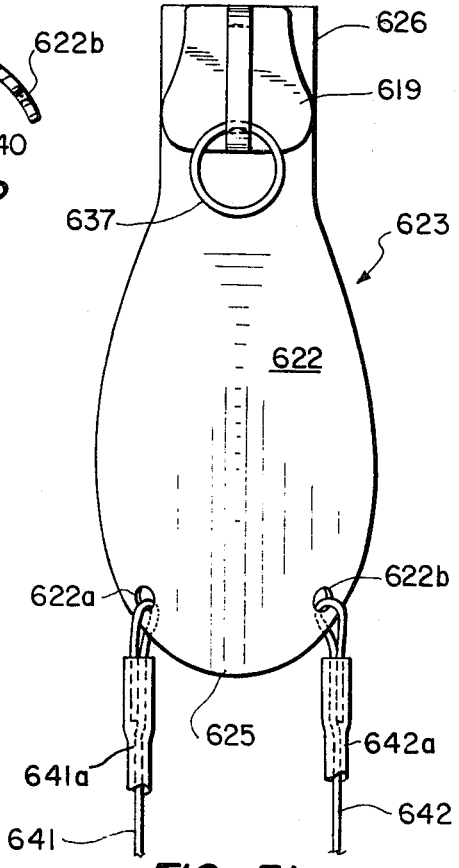
FIG. 31

WORKING SAILS AND METHODS FOR FURLING THEM WHILE ALOFT

The invention relates to working sails and to methods for furling them while the sail is aloft.

BACKGROUND OF THE INVENTION

Furling of working sails has historically been accomplished by direct manual manipulation of the sail, requiring that one or more of the crew go forward (in the case of a headsail) or at least out of the cockpit (in the case of a mainsail). Furling of working sails is required under various conditions, including conditions of increasing wind and heavier seas. Furling by direct manual manipulation is at best laborious and often unduly dangerous, especially when furling is required during the changing of sails at sea under heavy weather conditions. Accordingly, prior-art workers have long sought to devise both improved methods and improved sail systems in an effort to overcome the disadvantages of manual furling and changing sails.

Prior-art efforts have concentrated mainly on furling of headsails and the most successful of the prior-art systems have been those based on the so-called "roller furling" approach, wherein the luff of the sail is rolled or wound upon either the headstay or a member independent of but adjacent to the headstay. Typical systems of that type are disclosed in U.S. Pat. Nos. 3,611,969 Hood; 3,851,609 Stearn; 3,964,419 Uecker; 3,980,036 Crall; 4,034,694 Dismukes.

Though roller furling systems have achieved rather wide acceptance, they present certain inherent difficulties. Thus, when the roller furling member is of the type which itself must be under tension, the furling member must be supported by bearings and applies a high tension load to the bearings so that the bearings must be serviced frequently and are subject to undue wear. If the furling member encloses and rotates about the headstay, so that the furling member itself is not under tension, torsion problems are encountered since, e.g., a turning moment imparted to the foot of the member is not immediately transmitted to the head of the member, the result being that the furling member is twisted and the sail is not rolled uniformly from head to foot. When the roller furling member is the headstay or directly associated with the headstay, the sail cannot be lowered at all in its furled condition. If the roller furling member is separate from the headstay, the sail can be lowered in its furled condition, but the stiffness and length of the furling member make handling and stowing the furled sail very difficult. Because of the need for a furling drum at the foot, and a swivel at the head, roller furling significantly reduces the length of the headstay which can be occupied by the sail, and eliminates the sail skirt. If roller furling is to be used, the sail must be flat, or virtually flat; the sail can have little or no draft. When the furling member is separate from the headstay, as when a wire member is incorporated in the luff of the sail, the sail exhibits excessive luff sag in all but the lightest of air. Since a roller furled sail is at best difficult to lower in furled condition, the sails are usually left aloft when furled and are thus exposed to the elements for protracted periods. To protect the sail, weather-resistant cover material has been added along the leech and foot, so as to be wound on the outside of the furled sail, but addition of this material, which is relatively heavy, tends, e.g., to collapse the sail in light air. Finally, while roller furling has been applied to mainsails, its use for mainsails is essentially impractical, requiring extensive mast modification and undue limitation of sail area. Such difficulties have generated a continuing need for improvement in the art of furling working sails while aloft.

OBJECTS OF THE INVENTION

A general object is to devise a method for furling working sails while aloft, and a sail system with which the method can be practiced, with all operations required to accomplish furling being carried out from a location, such as the cockpit of the vessel, which is remote from the sail.

Another object is to provide such a method and system which does not involve rolling of any portion of the sail, but rather folds or flakes substantially the entire sail.

A further object is to provide such a method and system which not only furls the sail aloft but results in the furled sail being enclosed in an elongated tubular bag so that the furled sail can be left aloft in a position parallel to and adjacent the stay or mast.

Another object is to devise a method and sail system such that the sail can be completely furled and enclosed in a tubular bag while aloft with the leading edge of the sail still attached to the stay or mast.

Yet another object is to devise such a method and sail system wherein the sail is not encumbered by elongated stiff elements, can be easily lowered in its bagged condition and easily stowed on board the vessel, and can be easily run back up in its bagged condition and then unfurled.

A further object is to devise an improved method for furling, lowering and stowing a working sail.

An additional object is to provide an improved sail stowage bag, and the combination of such a bag with sails stowed therein in an improved fashion.

Another object is to provide such a method and sail system which assists in reefing the sail while aloft.

Another object is to provide a sail which can be remotely furled while aloft and, when furled, can be left aloft and is protected from the elements.

A further object is to provide a method and sail system which makes it practical to furl any working sail aloft, which does not require that the sail be essentially without draft and does not limit or decrease sail area.

A still further object is to provide a remotely operable travelling furler for furling sails while aloft.

SUMMARY OF THE INVENTION

According to method embodiments of the invention, flexible sheet material is provided which extends along the sail from head to foot; the sail is at least preliminarily furled; commencing at one end of the at least preliminarily furled sail, said flexible sheet material is progressively formed into a tubular bag enclosing the sail in furled form; and, as the bag is formed, the bag is progressively secured against opening; all of the steps necessary for furling and bagging the sail being carried out while the sail remains connected to the stay or mast. The flexible sheet material from which the bag is formed can be material in addition to the sheet material of the sail, or can include additional material and a part of the sheet material of the sail itself, or can be made up entirely of sheet material of the sail itself. In particularly advantageous embodiments, the steps of progressively furling the sail, progressively forming the tubular bag about the furled sail and progressively securing the bag against opening are accomplished simply by pulling furling line means from a remote point, such as the cockpit, and thereby pulling a travelling furler and separable fastener runner downwardly from head to foot, the furler advantageously including an intermediate portion, engaged over the leech, and two arms which extend from the intermediate portion each on a different side of the aft portion of the sail, the runner of the separable fastener being connected to the intermediate portion of the furler, and the combination of furler and runner being pulled downwardly by furling line portions attached to the arms of the furler.

Advantageously, the flexible sheet material from which the tubular bag is formed extends along the leading edge of the sail so that, when the sail has been furled and bagged, the tubular bag containing the sail extends along the stay or mast, and the sail, though furled and bagged, remains attached to the stay or the mast and can be lowered simply and easily, or left aloft. All or a selected portion of the flexible sheet material from which the bag is formed can be of a material resistant to weathering, particularly to the effects of ultra-violet light.

The invention applies to all working sails, i.e., any sail used for a particular boat on most or all points of sail. Specifically included are jibs, staysails (when used on a boat such as a cutter such that the staysail is used on most or all points of sail), mainsails and mizzens. Working sails are to be distinguished from spinnaker-type sails.

IDENTIFICATION OF THE DRAWINGS

In order that the manner in which the foregoing and other objects are attained according to the invention can be understood in detail, particularly advantageous embodiments thereof, including the current best method and apparatus modes, will be described with reference to the accompanying drawings, which form part of the original disclosure of this application, and wherein:

FIG. 8 is an enlarged side elevational view of the furler of FIGS. 5–7 in operative position on the sail during furling;

FIG. 30 is a side elevational view of a combined travelling furler and separable fastener useful according to the invention;

FIG. 31 is a plan elevational view of the furler of FIG. 30; and

FIG. 32 is a transverse sectional view taken generally on line 32—32, FIG. 30.

DETAIL DESCRIPTION OF THE SAIL SYSTEM OF FIGS. 1–14

Figure 1:
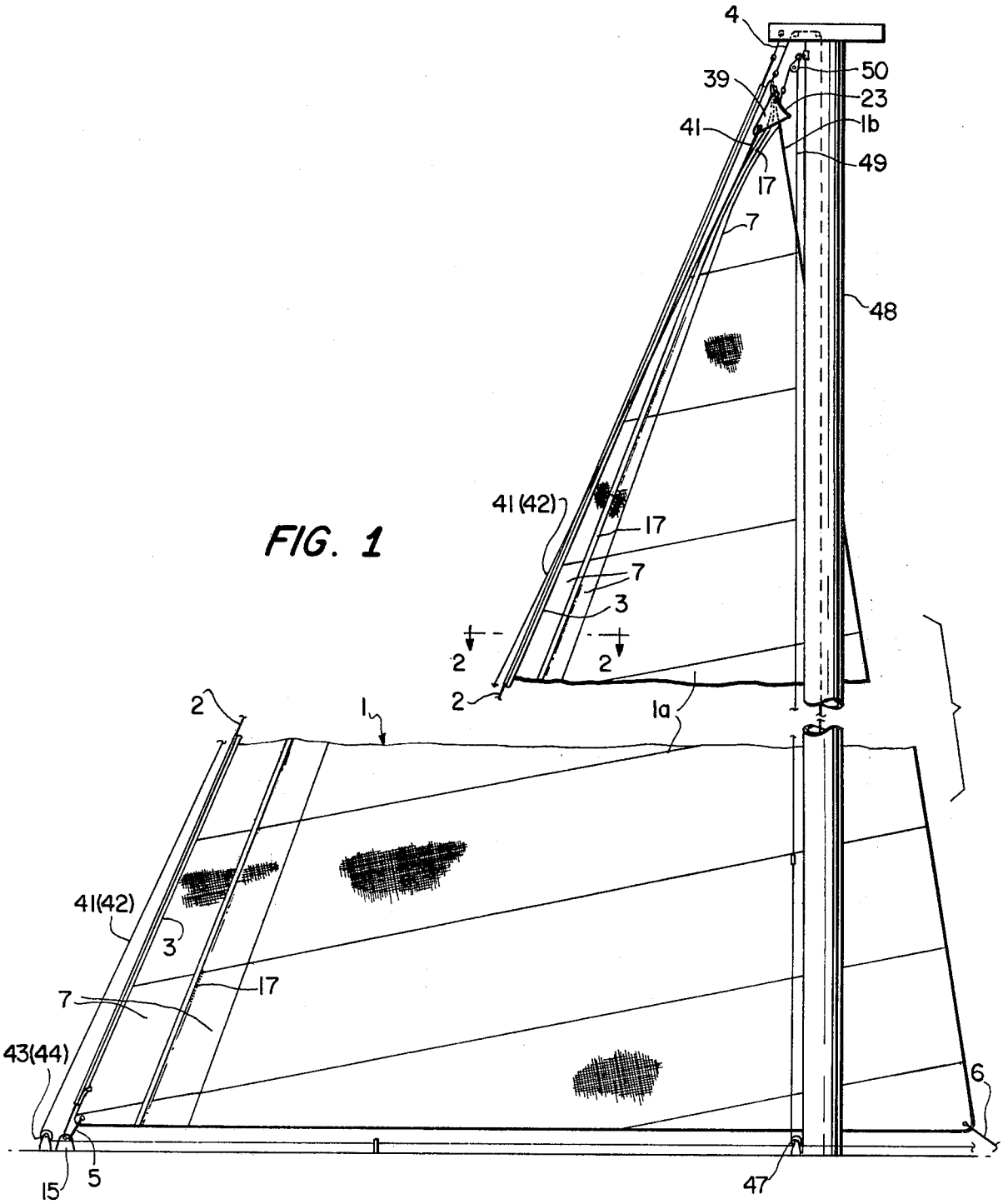
FIG. 1 is a semidiagrammatic side elevational view of a jibsail according to the invention, with the sail unfurled and set.
Figure 2:
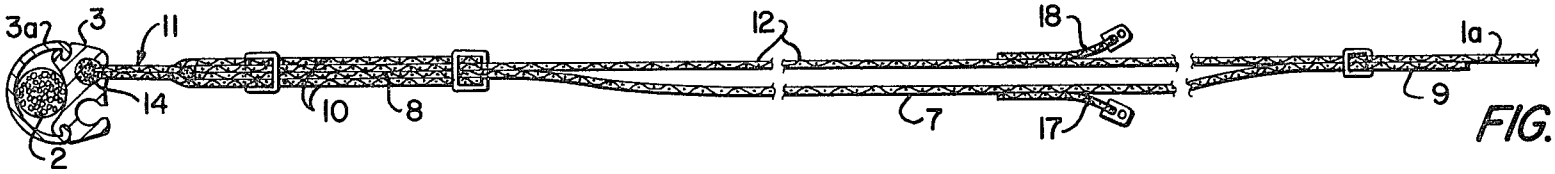
FIG. 2 is a sectional view taken generally on line 2—2, FIG. 1, and on larger scale than FIG. 1.

FIGS. 1–14 illustrate the invention as applied to a jibsail 1 connected to headstay 2 by a conventional assembly of grooved headstay extrusions 3 and **3*a*, FIG. 2, and equipped with a hayard 4, a tack cringle secured by tack hook 5 and sheets 6. The sail can be of any sail cloth suitable for a working sail and is advantageously of a fabric woven from polyethylene terephthalate fiber (e.g., that marketed as DACRON by E. I. du Pont de Nemours & Co., Wilmington, Delaware), and includes a main sail body, indicated generally at 1*a*, and a reinforced head area, indicated at 1*b*** and seen in detail in FIG. 3. Main body 1*a* is in the form of a single sheet of fabric made up of a plurality of panels as shown, the panels being cut and sewed, with conventional broad seam tapering, to provide the substantial draft, i.e., camber or transverse curvature, when the sail is set and flying, required for optimum sail performance. Reinforced head area 1*b* is also of conventional form, made up of a plurality of panels with the panels being of multiple sheets of fabric varying progressively from, e.g., 7 sheets for the uppermost panel to, e.g., 2 sheets for the lowermost panel of the head area. Thus, head area 1*b* is substantially stiffer than the main body 1*a* with the increased stiffness being maximum at the uppermost panel and minimum at the lowermost panel of the head area.

Figure 4:
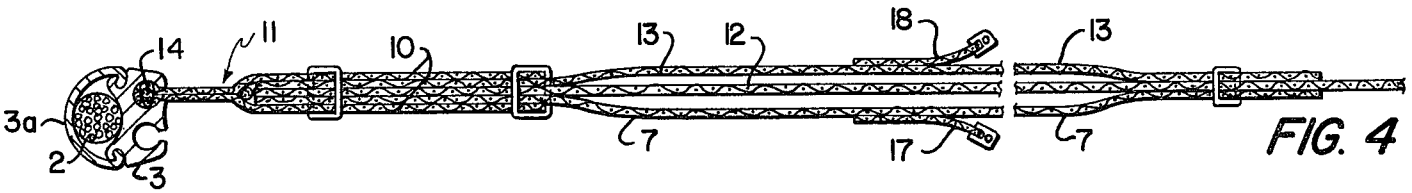
FIG. 4 is a sectional view taken generally on line 4—4, FIG. 3.
Figure 3:
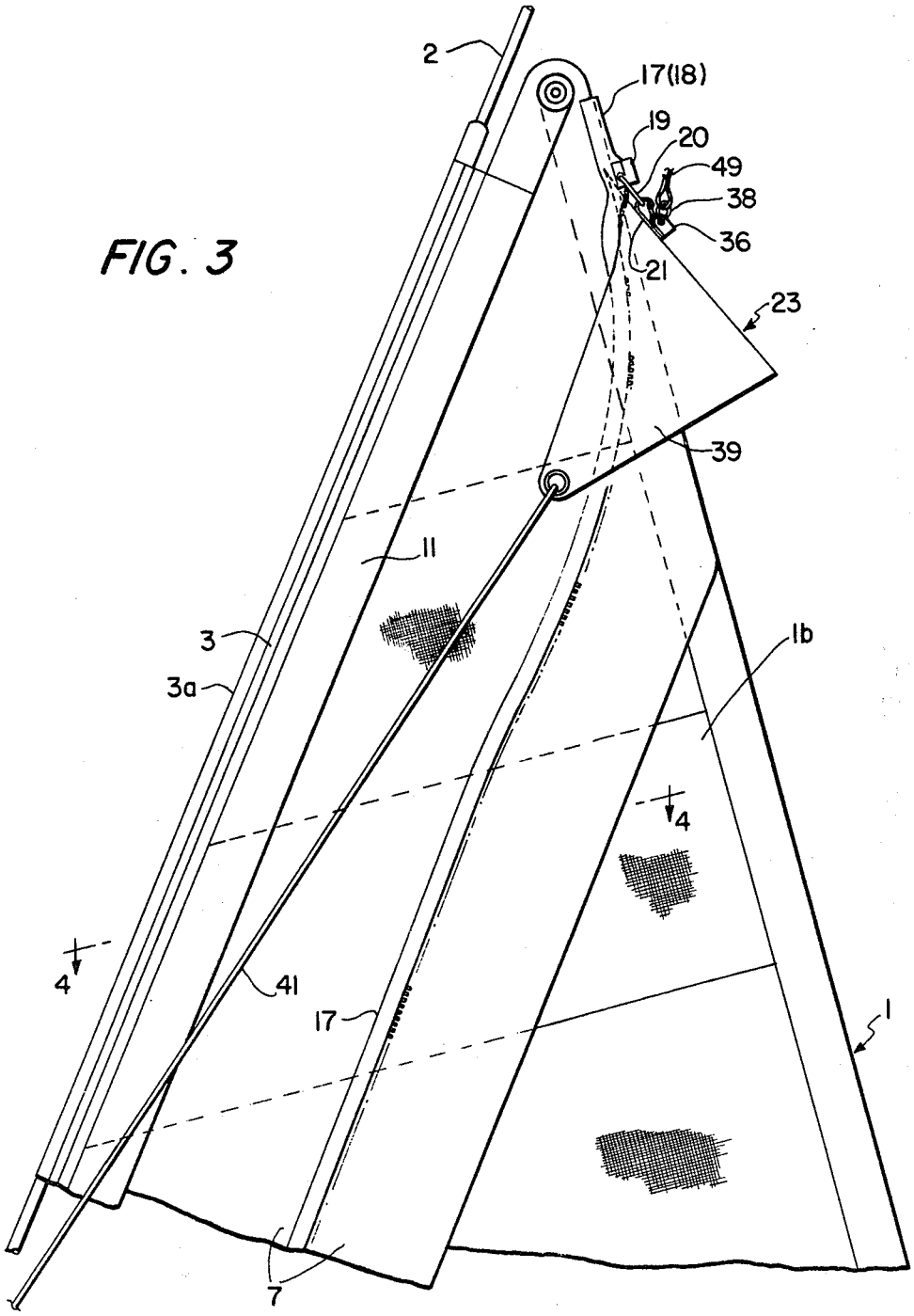
FIG. 3 is a fragmentary side elevational view enlarged relative to FIG. 1 and illustrating the head portion of the sail of FIG. 1.

Sail 1 is unique in that it comprises an additional portion 7, FIGS. 1–3, made up of an elongated portion of flexible sheet material, typically a fabric woven of, e.g., polyethylene terephthalate, nylon or acrylic cover cloth fibers and having a weight of 0.5–13 oz. per squre yard, depending upon the particular sail. Acrylic cover cloths and specially finished polyethylene terephthalate fabrics are available which are resistant to ultra-violet light. Added portion 7 extends completely from the head of the sail to the foot of the sail on one side only (the port side in this embodiment) and has a leading edge 8, which overlies and is secured to the leading edge of sail body 1*a* and reinforced head area 1*b* as seen in FIGS. 2 and 4, and a trailing edge 9 which extends over and is secured to the sail along a line spaced aft of the leading edge of the sail. Between leading edge 8 and trailing edge 9, added portion 7 is free and unattached, both with respect to the main body of the sail and with respect to the head area, and lies normally against the sail, separation between portions 1*a* and 7 and portions 1*b* and 7 being exaggerated in the drawings for clarity. Securing leading edge 8 to the leading edge of the sail and headboard is advantageously accomplished by having the leading edges of both the sail and portion 7 disposed within the two plies 10 of the conventional luff tape 11 and stitching through the luff tape with heavy duty polyethylene terephthalate thread. The trailing edge of added portion 7 is simply sewed to the sail. Trailing edge 9 of added portion 7 slants at a small angle downwardly and aft so that portion 7 overlies that triangular portion of main sail body 1*a* which is immediately aft of the leading edge of the sail. The head end of added portion 7 extends upwardly over the leading portion of head area 1*b*, trailing edge 9 of portion 7 being parallel to the leading edge of head area 1*b*, and the upper end of portion 7 extending across and being stitched to the leech of the head area.

Commencing at the foot of head area 1*b*, the seam between the trailing edge 9 of added portion 7 and the main body of the sail, together with the seam along luff tape 11, defines a forward portion 12 of the sail which has the same dimensions and shape as that part of portion 7 below the headboard. Below reinforced head area 1*b*, sail portion 12 is fully exposed, no sheet material being added on the starboard side of the sail. Over head area 1*b*, however, this side also carries an additional portion 13 of flexible sheet material, as seen in FIG. 4, portion 13 being complementary to, and corresponding in size and shape to, the upper end portion of added portion 7. The leading edge of portion 13 is secured by stitching between one ply 10 of the luff tape and the starboard surface of the leading edge of the head area. The trailing edge of portion 13 is stitched directly to the head area. Portion 13 extends across the leech of the head area and is stitched thereto. Save for its leading and trailing edges and for being stitched to the leech, portion 13, like portion 7, simply overlies head area 1*b* and is not attached thereto.

Luff tape 11 is a conventional luff tape for use with the slotted headstay extrusions and, therefore, includes along its leading edge a boltrope 14, FIGS. 2 and 4, engaged in the headstay slot as shown. Headstay 2 is secured to a conventional bow fitting 15, FIG. 1, and to the masthead assembly 16 so as to be under tension, and the grooved extrusions 3 combine with extrusions 3*a*, FIG. 2, to slidably embrace the stay in usual fashion. With the leading edge of the sail held in tension by the halyard, and with boltrope 14 securely engaged in the groove of the extrusion, the leading edges of the sail and added fabric portions 7, 13 are held taut, secure and parallel to the headstay when the sail is set.

The sail is equipped with a separable fastener comprising two elongated flexible fastener elements 17 and 18 and a runner 19. Element 17 extends from the head of the sail to the foot along the outer surface of added fabric portion 7 and is secured to that portion throughout its length. Element 18 extends from the head of the sail, first along added fabric portion 13, then along the starboard surface of sail portion 12, to the foot. As best seen in FIG. 3, both elements 17 and 18 cross the leech of reinforced head area 1*b*, the head end portions of elements 17 and 18 being closed at the leech and secured there, in closed condition, to the respective ends of portions 7, 13 and the underlying leech. Thus, the separable fastener is maintained permanently closed at its extreme upper end.

In this embodiment, fastener elements 17 and 18 are opposite each other, through the thickness of the sail material and added fabric portions therebetween, throughout their length and therefore extend along mutually parallel lines (when the sail is set) which first curve from the leech to become parallel with the leading edge of the reinforced head area 1*b*, then remain parallel to that leading edge throughout the length of the head area 1*b*, and then slant downwardly and aft at a small angle away from the leading edge of the sail. Save for their permanently closed upper ends, fastener elements 17, 18 are (when the sail is set) spaced aft of the leading edge of the sail by a distance which is slightly more than 50% of the fore-to-aft seam-to-seam dimension of added fabric portion 7. The separable fastener can be of any conventional type capable of being progressively closed by moving runner 19 along elements 17, 18 in one direction and progressively opened by movement of the runner along the fastener elements in the opposite direction. It is particularly advantageous to employ as the separable fastener a heavy duty conventional slide fastener of the type commonly referred to as a zipper since such fasteners are characterized by having, as elements 17 and 18, fabric tapes equipped with teeth along one edge of the tape and such tapes can be readily and securely sewed to fabric portion 7, sail body 1*a* and fabric portion 13.

Figure 7:
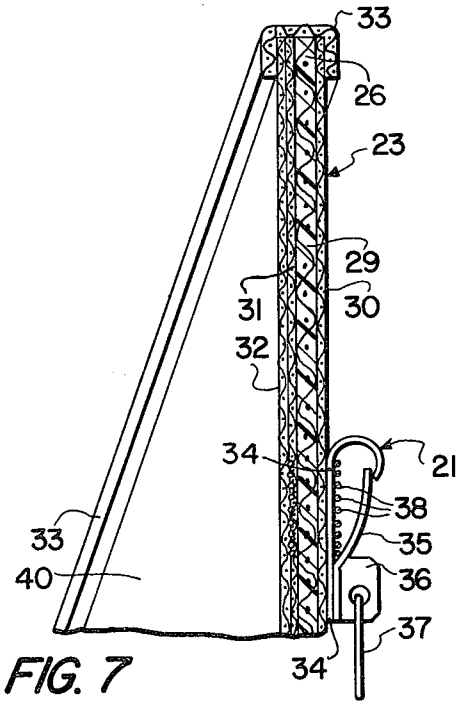
FIG. 7 is a detail sectional view taken generally on line 7—7, FIG. 6.

Runner 19 of the separable fastener is releasably attached by ring 20 to a releasable fastener 21 secured to the intermediate portion 22 of a travelling furler indicated generally at 23, FIGS. 5–8. Furler 23 is in the form of a flexible laminated body 24 which is generally triangular in projected plan and is defined by an elongated leading edge 25, a relatively short trailing edge 26 and two equal side edges 27, 28 interconnecting the respective ends of the leading and trailing edges. As seen in FIG. 7, body 24 comprises an intermediate ply 29 of relatively thick and heavy fabric, a relatively thinner outer ply 30 of woven fabric, a like inner ply 31, and an inner surface ply 32 which presents, as its inner face, a smooth and uninterrupted surface which is at least non-abrasive and at best characterized by inherent lubricity. Plies 29–31 are secured together, advantageously by stitching, both along the marginal portions of body 24 and over the remainder of the body area. Inner surface ply 32 is secured to plies 29–31 only along the marginal or edge portions of body 24. Thus, when ply 32 is secured by stitching, none of the stitches is exposed at the surface of ply 32 which engages the sail. The marginal portions of body 24 are bound with a strip of relatively thick, strong and compressible binding material, best seen at 33, FIG. 7, by stitching which extends through all of the plies, the stitches being indented in the outer portion of the binding material. Intermediate ply 29 is typically of a woven fabric impregnated and coated with a flexible and strong polymeric material. Thus, the so-called "cloth-backed vinyl" materials, such as are marketed under the trademark NAUGAHYDE by Uniroyal, Inc., New York, New York, are especially suitable. Plies 30 and 31 can be of fabric woven from polyethylene terephthalate fiber and having a weight of 9–10 oz. per square yard. Inner facing layer 32 is advantageously of either a hard finish woven nylon fabric or a polymeric film. When a woven nylon fabric is employed, one having a weight of 3–6 oz. per square yard is especially suitable. When a polymeric film is used, a transparent polyvinylidene chloride film with a weight of 10–15 oz. per square yard and a thickness on the order of 1/64 in. is particularly suitable. For the binding material 33, elkhide and cloth-backed vinyl materials are particularly useful.

As seen in FIG. 7, fastener 21 comprises a flat metal arm 34 bent at one end to form the hook of the fastener, a flat spring 35 secured at one end to arm 34 and biased to engage the end of the hook, and an apertured plate 36 secured to the end portions of arm 34 and spring 35 and lying in a plane at right angles to the plane of the arm. A ring 37 extends through the aperture of plate 36. Arm 34 extends in flat condition for a significant distance between its junction with spring 35 and the hooked end and is fixed to body 24 by lashing 38 stitched through plies 29–31 and over the arm. Thus secured to the travelling furler, fastener 21 is held in such position that the fastener is centered transversely on intermediate portion 22 with the hook of the fastener opening toward leading edge 25 and with both the hook of the fastener and ring 37 located nearer to edge 26 than to edge 25.

Figure 5:
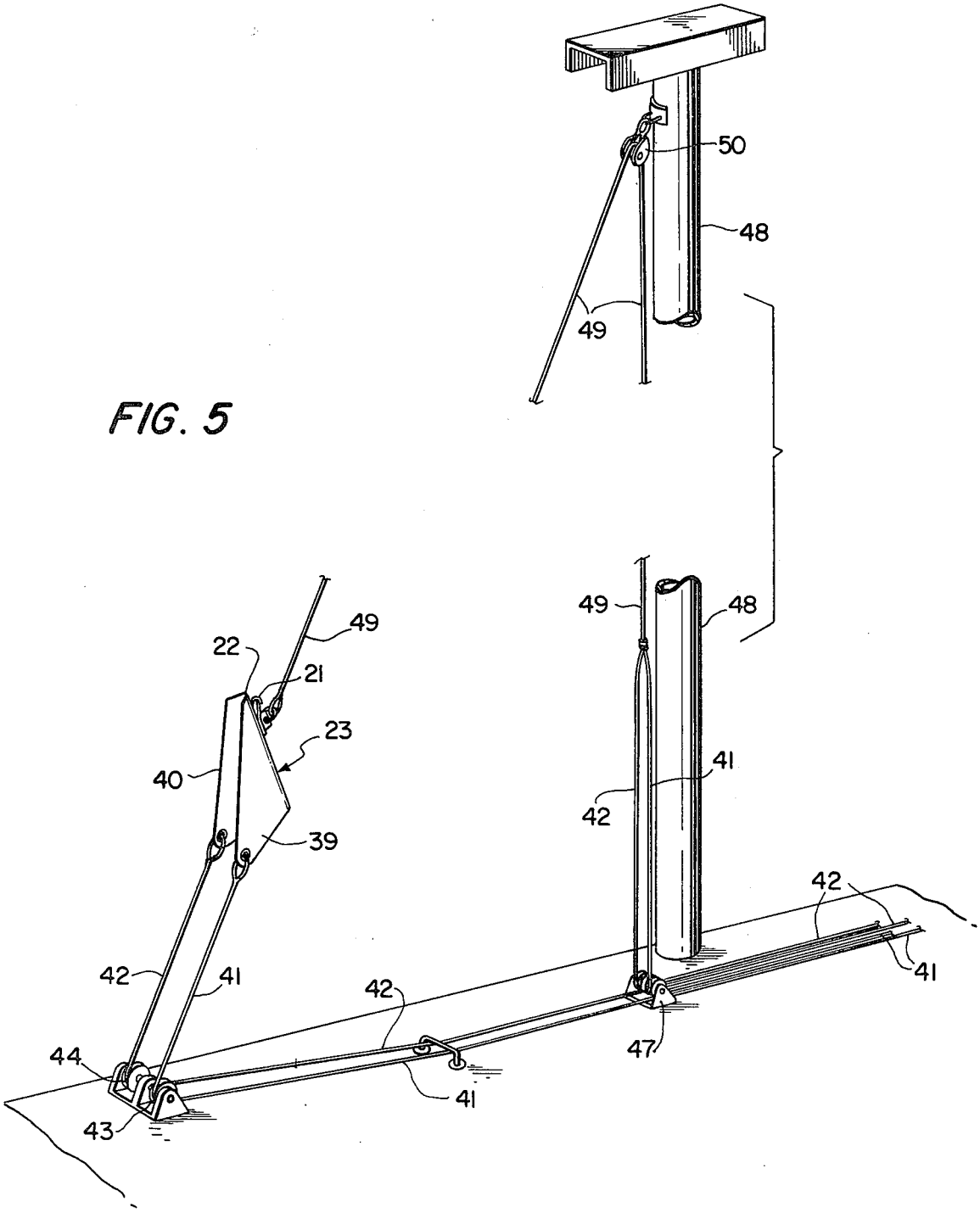
FIG. 5 is a perspective semidiagrammatic view of a travelling furler and closed loop line means employed with the sail of FIG. 1.
Figure 9:
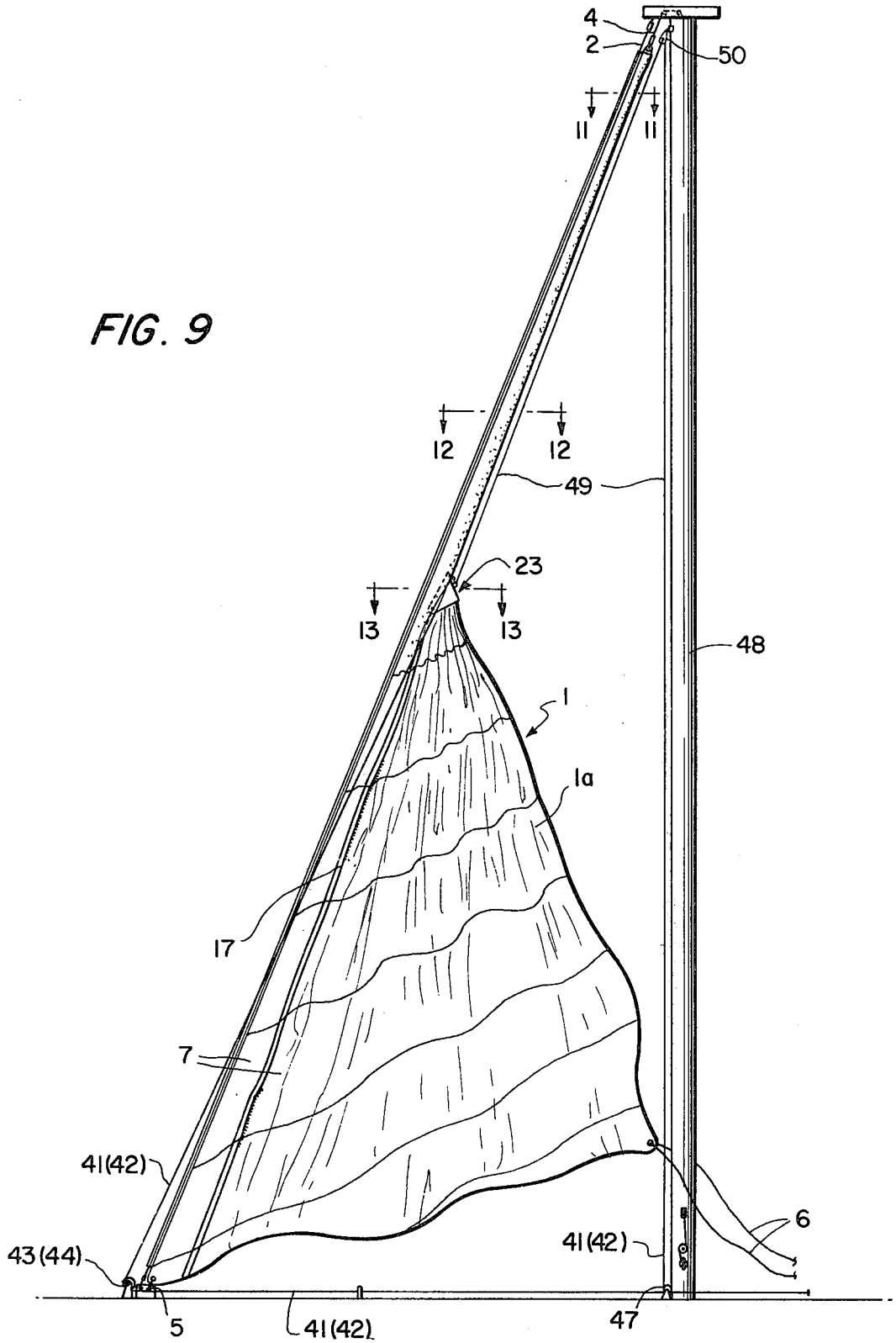
FIGS. 9 and 10 are views similar to FIG. 1 but showing the sail partially furled and bagged and fully furled and bagged, respectively.

Edge 27 and the corresponding portion of edge 25 define an elongated triangular arm 39. Similarly, edge 28 and the other half of edge 25 define a second elongated triangular arm 40. At their free ends, arms 39 and 40 are equipped with cringles 41*a* and 42*a*, respectively. As best seen in FIG. 5, a first furling line 41 is connected to arm 39 through cringle 41*a* and a second furling line 42 is connected to arm 40 through a cringle 42*a*. Furling lines 41, 42 run downwardly from the travelling furler, and about sheaves 43 and 44, respectively, which are secured to the deck immediately forward of jibstay bow fitting 15 as seen in FIG. 1. From the bow, lines 41, 42 are run aft to the cockpit of the vessel, thence again forward, under a sheave 47 at the foot of the mast 48 and, from sheave 47 up the mast to join a single unfurling line 49. The unfurling line is run over a block 50 secured to the mast immediately below the masthead assembly, then downwardly to furler 23 to which the unfurling line is attached by ring 37.

Figure 6:
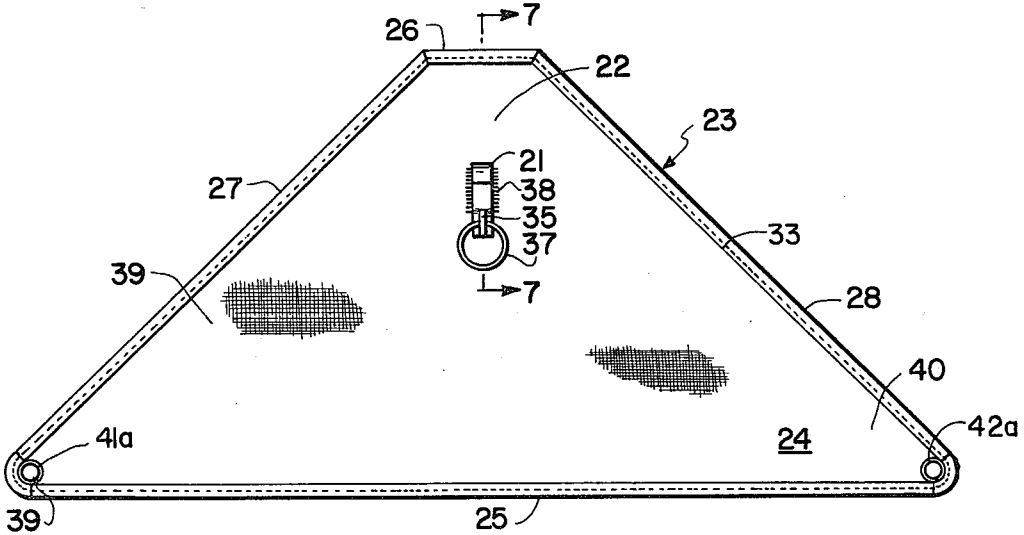
FIG. 6 is a projected plan view of the travelling furler.

Comparing FIGS. 6 and 8, and recognizing that FIG. 6 is a projected plan, it will be seen that when body 24 is not under tension, as later explained, the body is of generally U-shaped transverse cross section, intermediate portion 22 being substantially straight from leading edge to trailing edge and the arms 39, 40 projecting away from the intermediate portion. When the furler is in its position of use, FIG. 5, intermediate portion 22 is upwardly exposed and arms 39, 40 can be considered as depending from the intermediate portion and slanting downwardly and outwardly. Since body 24 is relatively thick, the lateral dimensions of the four plies making up the body increase from inner ply 32 to outer ply 30, and the plies are sewed with the body in its generally U-shaped form so that that configuration persists when sewing is complete.

As illustrated in FIG. 8, runner 19 of the separable fastener is of conventional configuration and is detachably connected to the travelling furler by ring 20 engaged over the hook of fastener 21 and retained in place by spring 35. FIGS. 3 and 8 show travelling furler 23 and fastener runner 19 in their uppermost positions, with the sail aloft. FIG. 5 illustrates the furler and furling lines after the sail, having been furled and bagged, has been detached from the furler by disengaging runner 19 from fastener 21.

Considering now the practice of the method of the invention by use of the sail system shown in FIGS. 1–14, assume that the sail has been attached to the headstay in conventional fashion, run up, and set as seen in FIG. 1, and that it is desired to furl the sail, as when sailing is finished or when the sail is to be changed. Before furling is commenced, furler 23 and fastener runner 19 are in their uppermost positions, arms 39, 40 of the furler curving over fastener elements 17 and 18, respectively, and thence extending downwardly and forwardly over the outer surfaces of fabric portions 7 and 13, respectively, the furler remaining in that position, and under light tension applied by the furling lines and the unfurling line so long as furling lines 41, 42 are secured at the cockpit. At this stage, the trailing end portion of intermediate portion 22 of the furler underlies runner 19 and projects a short distance upwardly therefrom, and this disposition persists until ring 20 is detected from fastener 21 and the furler removed from the sail. A greater portion of the furler, lying downwardly or in front of runner 19, embraces the leech of the sail and is thus interposed between the sail and those portions of fastener elements 17, 18 which are below runner 19 and, therefore, as yet disconnected from each other. Advantageously, the disposition of fastener 21, the point of connection for unfurling line 49, and the ends of arms 39, 40 to which furling lines 41, 42 are attached, and the dimensions of portion 22 are such that, when the furling and unfurling lines are tensioned and the furler is engaged over the leech of the sail, intermediate portion 22 slants generally downwardly and aft at an angle of approximately 45°. The sail is furled progressively from head to foot by pulling down on furling lines 41, 42. This is accomplished from the cockpit by grasping both furling lines and pulling them aft. Since the combination of furling lines 41 and 42, unfurling line 49 and travelling furler 23 extends as a closed loop, unfurling line 49 is pulled downwardly from block 50 as a result of downward travel of furler 23, so that what would otherwise be the slack in the furling lines is drawn forwardly from the cockpit and thence up the mast.

At the outset of furling, intermediate portion 22 of the travelling furler is engaged over the leech of the sail and is urged both downwardly and forwardly by the tension applied to arms 39, 40 by the furling lines. As the furler travels downwardly, it first traverses the aft portion of head area 1*b*, urging the material of that portion forwardly. Since sheaves 43, 44 are positioned just forward of the jibstay fitting, furling lines 41, 42 pull the furler downwardly and slightly forwardly, so that as the downward travel of the furler progresses toward the foot of head area 1*b*, the furler forces the aft portion of the head area forwardly, carrying the juncture between the trailing edges of fabric portions 7, 13 toward the leading edge of head area 1*b*. As a result, the aft portions of fabric portions 7, 13 are turned inwardly, to commence progressive formation of a tubular bag, and the part of the head area 1*b* between the trailing edges of fabric portions 7, 13 and the leech is folded into the bag as the bag is formed. Since runner 19 of the separable fastener is attached to furler 23, the runner follows the furler, progressively joining fastener elements 17, 18 to close the fastener and secure the formed portion of the bag against opening. It is the portions of fabric portions 7, 13 between fastener elements 17, 18 and the seam between the trailing edges of portions 7, 13 and the sail which form the bag portion directly containing all of reinforced head area 1*b* of the trailing edges of portions 7, 13, as will be clear from FIG. 11, and it will be noted that the fore portions of fabric portions 7, 13 between the leading edge and fastener elements 17, 18 enclose not only the bag portion just mentioned but also the fore portion of reinforced head area 1*b*, i.e., that portion between the leading edge of the reinforced head area and the trailing edges of fabric portions 7, 13.

As furler 23 progresses beyond the foot of reinforced head area 1*b*, it leaves fabric portion 13 and commences to force the aft portion of the main body 1*a* of the sail forwardly between those portions of added fabric portion 7 and sail portion 12 which lie between fastener elements 17, 18 and the juncture between trailing edge 9 of fabric portion 7 and the sail. Since the intermediate portion 22 of the furler is engaged over the leech while flexible arms 39 and 40, held under tension by the act of pulling the furling lines, embrace the aft portion of the sail, and since the furler moves along the material of the sail, the aft portion of the sail is not simply crumpled and stuffed forwardly. Rather, the furler coacts with added portion 7 and sail portion 12 to form the aft portion of the sail into a series of folds commencing at the trailing edge of portion 7 and progressing to the leech, much as the sail would be folded if "flaked" by hand.

Figure 13:
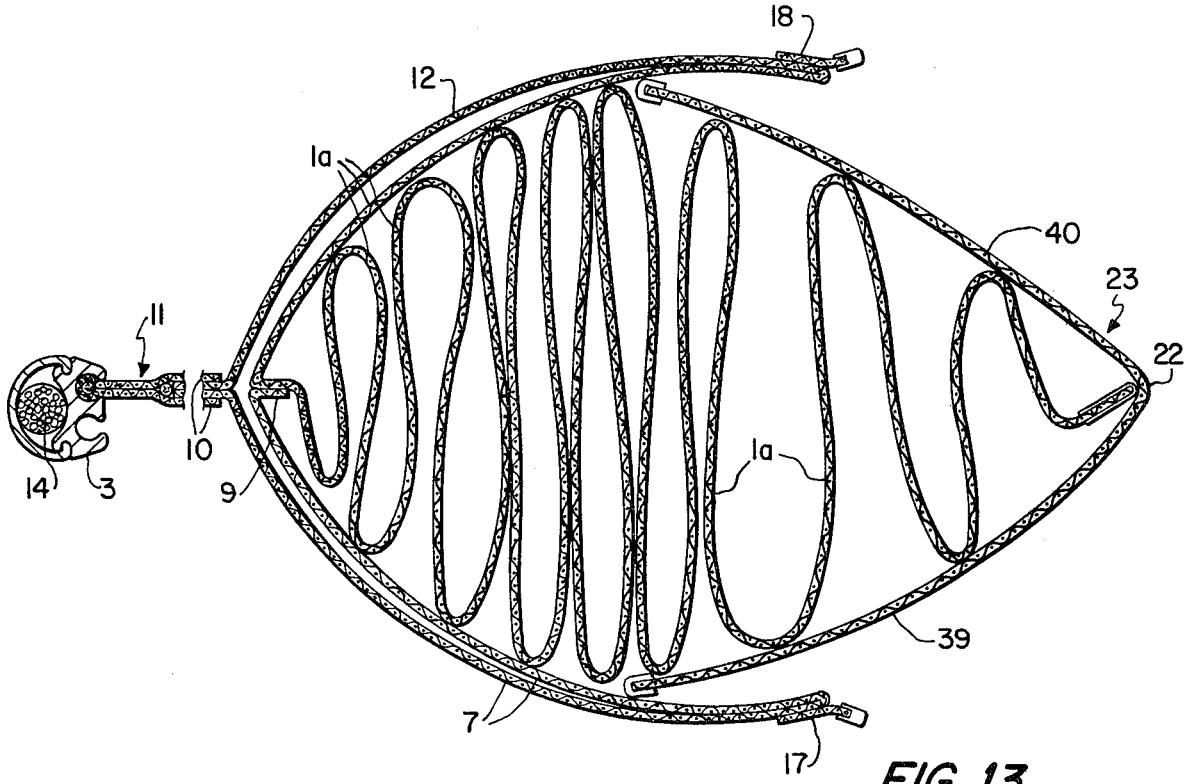
Figure 12:
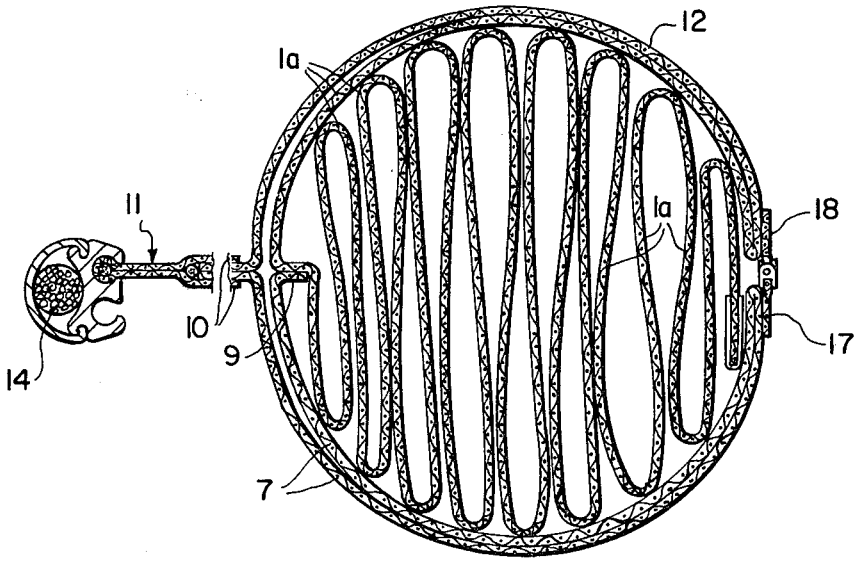
Figure 14:
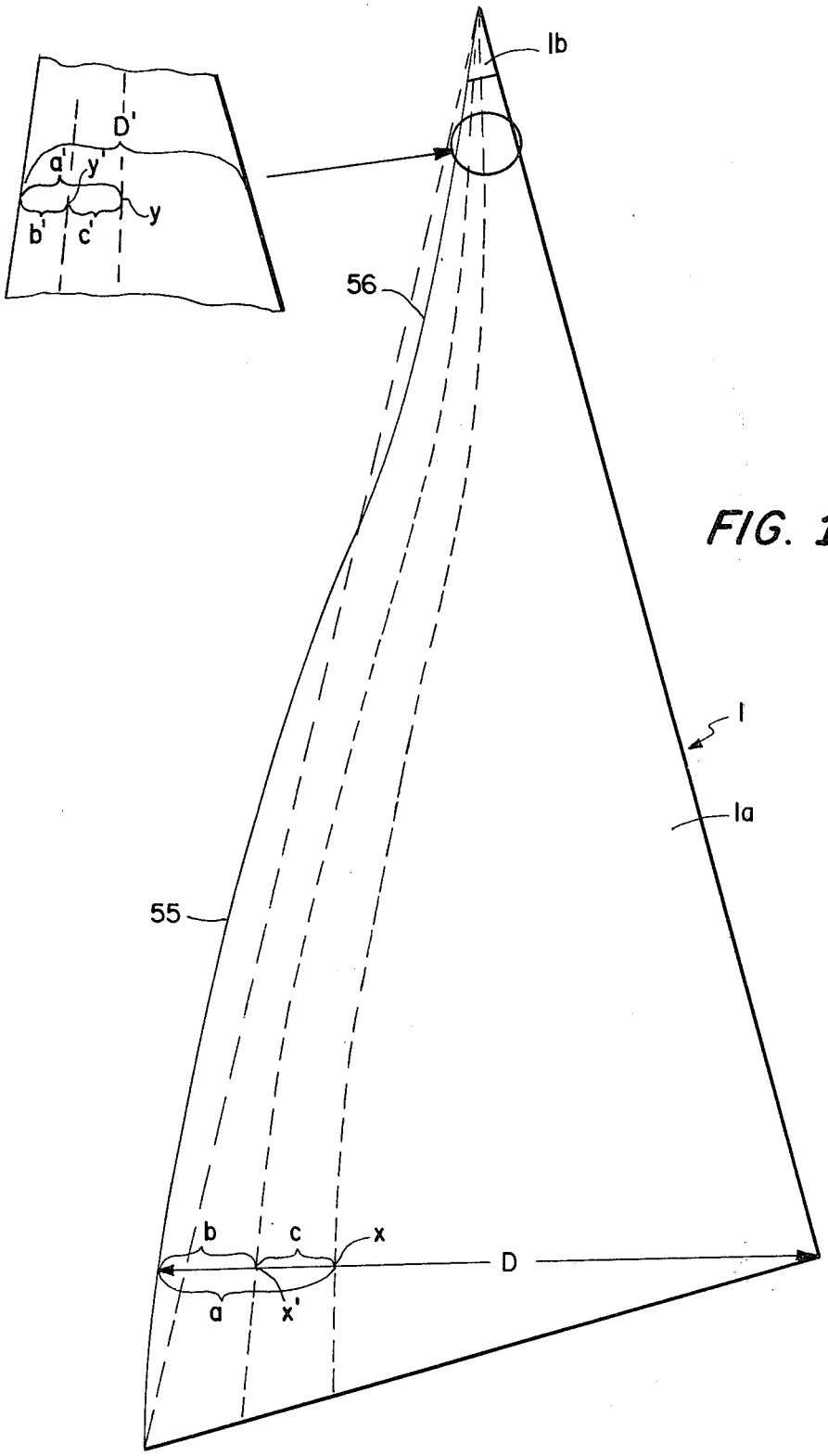
FIG. 14 is a plan view of the sail of FIG. 1 as that sail would be laid out in the sail loft prior to binding the sail.

While arms 39, 40 of the furler lie outside of headboard portions 7, 13 when the furler and fastener runner are in the uppermost positions seen in FIGS. 3 and 8, pulling the furler downwardly by lines 41, 43 inherently causes the arms of the furler to move in advance of the lower end of the forming bag, and the furler therefore acts not only to furl the sail but also to smoothly insert the furled sail material into the space between the now inwardly and forwardly extending aft portions of fabric portion 7 and sail portion 12, in the manner seen in FIG. 13. Pulled downwardly by furler 23, fastener runner 19 progressively closes fastener elements 17 and 18 in the manner shown in FIG. 8 and comparison of FIGS. 12 and 13. Such closing of the fastener secures the bag about the furled sail so that, when the furler has been pulled to its lowermost position, seen in FIGS. 5 and 10, the entire sail has been furled and enclosed within a tubular bag which is secured against opening. In this connection, it is to be noted that, with the sail thus furled and bagged, fastener runner 19 remains engaged with fastener elements 17, 18 and can be detached from the furler by removing ring 20 from fastener 21.

Since fastener elements 17, 18 extend along lines slightly nearer to the trailing edge of fabric portion 7 than to the leading edge of portion 7, the completed tubular bag includes an inner portion, which directly encloses the furled sail and is formed by those parts of portions 7 and 12 which extend between fastener elements 17, 18 on the one hand and the seam at trailing edge 9 on the other hand, and an outer portion defined by the parts of fabric portion 7 and sail portion 12 which extend forwardly from fastener elements 17, 18, the inner bag portion being extended in tension by the enclosed sail material, the outer bag portion not being tensioned but fitting relatively snugly about the inner bag.

The dimensions of added fabric portion 7 vary according to the details of the specific sail involved, including particularly the size of the sail and the weight and stiffness of the sail cloth. A general rule for designing added fabric portion 7 will be explained with reference to FIG. 14 which illustrates the plan for a jibsail having a curved luff, including a forward curve, indicated at 55 and extending for about the first $\frac{3}{4}$ of the length from foot to head, and a reverse or "compensator" curve indicated at 56 and extending for the upper $\frac{1}{4}$ of the sail. As a first step, the critical dimension D of the sail is determined by striking an arc through the clew about the head of the sail as the center and drawing a chord from the clew to the point at which the arc intersects the leading edge of the sail, the distance of the chord in feet being the critical dimension. The width a of portion 7 along the chord is then determined by the formula $$a = \sqrt{DK\pi}$$

where K is a sailcloth constant selected from the range of from 1 to 2 times the weight of the cloth in ounces per square yard. With main body 1*a* of sail 1 made from a woven polyethylene terephthalate fabric with a weight of 4.5 oz. per sq. yd., an appropriate value for K is $1.75 \times 4.5 = 7.9$. Assuming that critical distance D is 17 feet, then $$a = \sqrt{17 \times 7.9 \times 3.1416} = 20.54$$

and the value of a is read in inches. It should be noted that critical distance D is taken from the trailing edge of the sail to the leading edge of the sail, and that the dimension a is the distance from the leading edge of added portion 7 to, but not including, the seam at trailing edge 9.

With the dimension a having been determined, it is now necessary to determine dimensions b and c, dimension b being the distance from the trailing edge of the luff tape to and including the seam for fastener element 18, and dimension c being the distance from but not including the seam at fastener element 18 to but not including the seam at trailing edge 9 of added portion 7, both dimensions beng measured along the chord drawn in arriving at critical dimension D. Dimensions b and c are determined by the formulae $$b = \frac{a}{2} + T\% \frac{a}{2}$$

$$c = \frac{a}{2} - T\% \frac{a}{2}$$

where T is a constant in the range of 1–10 depending upon the weight of the sail cloth, the stiffness of the sail cloth and the snugness with which the bag is to embrace the furled sail. If the sail is 4.5 oz. polyethylene terephthalate cloth and the bag is to embrace the sail snugly but not so tightly as to unduly compact the folds of the furled sail, T×5 and $$b = \frac{20.54}{2} + .05 \times 10.27 = 10.78 \text{ inches}$$

$$c = \frac{20.54}{2} - .05 \times 10.27 = 9.75 \text{ inches.}$$

To lay out added fabric portion 7 and the lines along which the elongated flexible fastener elements 17, 18 are to be sewed, the aft end of dimension a is first marked on the sail cloth as point X. A second critical distance D′ is then determined in the same manner as distance D was determined but in a location immediately below reinforced head area 1*b*. Knowing distance D′, distance a′ is calculated and its aft end marked as point Y. If the leading edge of the sail is a straight line, the location for the seam at trailing edge 9 of portion 7 is marked by a straight line connecting points X and Y. Added fabric portion 7 can then be cut so that the leading edge of portion 7 coincides with the leading edge of the sail and the trailing edge of portion 7 is parallel to line X-Y but spaced aft thereof by the small distance necessary to accommodate the seam at trailing edge 9. If, as in FIG. 14, the sail is to be cut with luff curve 55, 56 a paper pattern is made for the curve and the pattern is used to mark the luff curve on the leading edges of both the sail cloth and the fabric for added portion 7. The leading edges of both the sail cloth and the fabric for portion 7 are then cut, and portion 7 placed on the sail cloth with its curved leading edge coincident with that of the sail cloth. Points X and Y are then marked on the fabric for portion 7 and the luff curve pattern is then used to connect points X and Y. The trailing edge of portion 7 is then cut, using the curved X-Y line as the guide. Distances b, b′ and c, c′ are then determined to locate points X′ and Y′ and the luff curve pattern is then used to mark the lines along which fastener elements 17 and 18 are to be sewed to added portion 7 and sail portion 12, respectively. Accordingly, trailing edge 9 of portion 7, though slanting downwardly and aft away from the leading edge of the sail, follows the same curve 55, 56 as does the leading edge of the sail. The end result is that the outer bag portion, formed by the parts of added portion 7 and sail portion 12 which are forwardly of fastener elements 17, 18 will be neither too loose along curve portion 55 nor too snug along curve portion 56.

When the sail is made up of panels and broad-seaming is used to provide draft in the sail, added portion 7 is panelled and broadseamed to match the sail.

LOWERING, STOWING AND CHANGING SAILS

After sail 1 has been completely furled and bagged, the sail can be lowered and stowed in a sail bag more easily and with greater safety than has heretofore been possible. When sailing is finished, the furled and bagged sail can be disconnected from travelling furler 23 by detaching ring 20 from fastener 21, the halyard is slacked and the sheets are disconnected, and the furled and bagged sail pulled down to the deck, leaving furler 23 and lines 41, 42 and 49 in place. Since the furled and bagged sail includes no elongated stiff elements, it is easily taken below in compact form.

Figure 15:
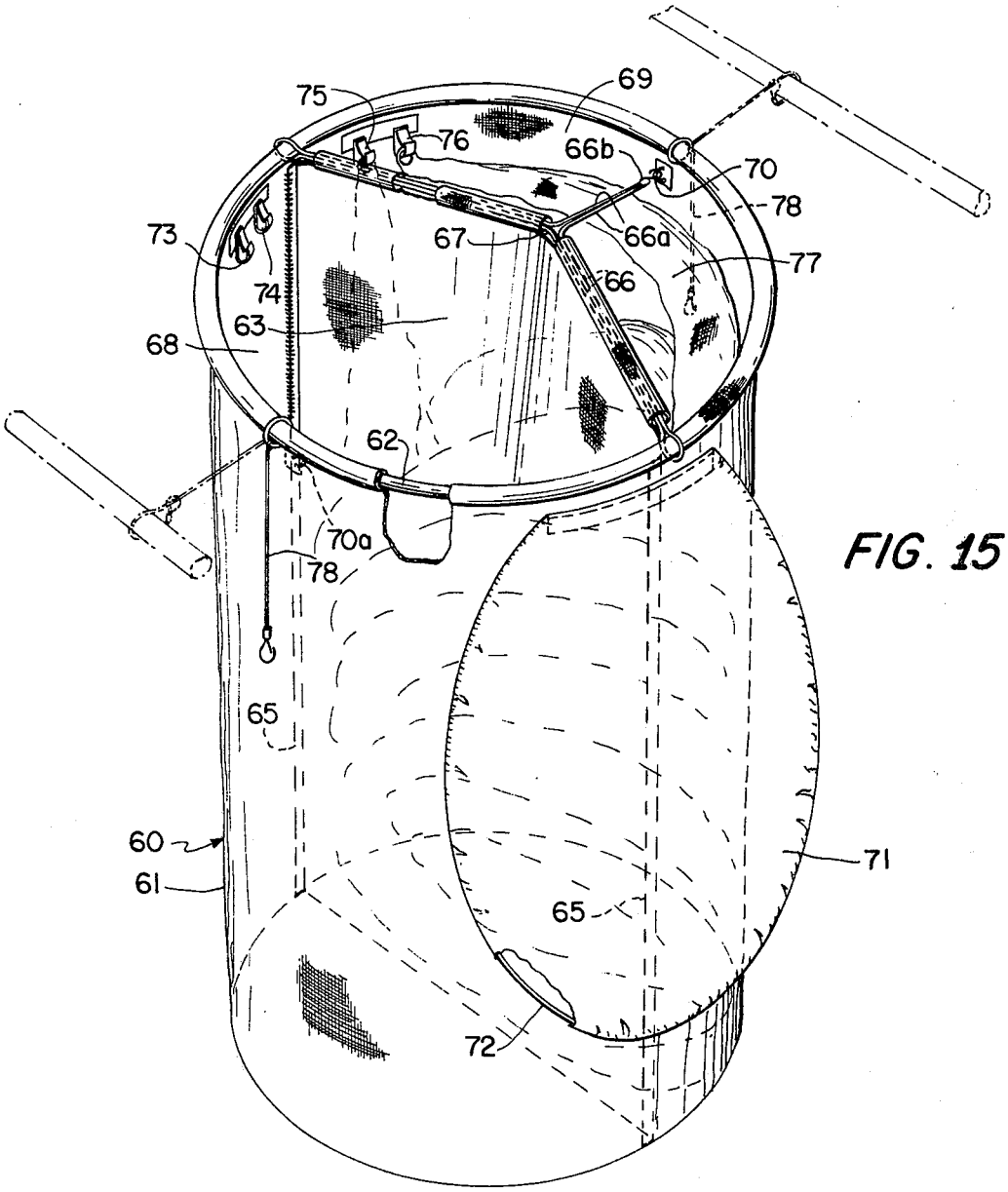
FIG. 15 is a perspective view of a sail stowage bag according to the invention.
Figure 15A:
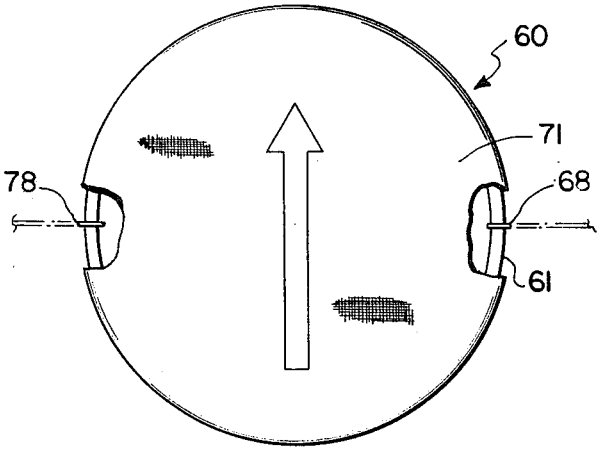
FIG. 15A is a top plan view of the bag of FIG. 15 with the cover closed.

When the tasks of lowering and stowing the sail are occasioned by the need to change sails at sea, it is advantageous to employ the dual sail bag 60 shown in FIG. 15. Bag 60 comprises a fabric body 61, a mouth reinforcement member 62, a fabric partition 63 and a fabric cover 71. Reinforcement member 62 can be of metal tubing, rod or rigging wire bent into a circular hoop. The mouth of body 61 is turned inwardly over member 62 and sewed to the fabric body below that member. Partition 63 has its side edges 65 sewed to the inner surface of body 61 along respective vertical lines which are diametrically opposed across the circular body of the bag. The partition is cut so that, when it is sewed in place, the fabric of the upper portion is significantly wider than is necessary to extend across the bag. The upper edge of partition 63 is hemmed loosely about a closed loop elastic cord 66 which also extends through openings in the hem at the top of the bag and is secured at each edge of the partition to reinforcement member 62. The hem at the top of the partition is cut away at its midpoint, providing an opening 67 through which a portion 66*a* of cord 66 is run, a hook 66*b* being attached to portion 66*a*. Partition 63 divides the interior of the bag into two compartments 68 and 69 which are generally semicircular in transverse cross section. Near the top of the bag, an eye 70 is secured to the inner surface of the side wall of the bag in a location spaced midway between the edges of the partition. Thus, by grasping hook 66*b*, one can stretch cord 66 and engage the hook in eye 70 so that the cord extends across the top of compartment 69 and deflects the upper portion of partition 63 toward eye 70, so enlarging the mouth of compartment 68. Cover 71 is a round piece of fabric hemmed peripherally to enclose an elastic band 72 having, when relaxed, a diameter smaller than reinforcing member 62, the cover being sewed to the mouth of bag body 61 adjacent one edge of partition 63 so as to be capable of being stretched over the mouth of body 61, the elastic band then being allowed to contract about body 61 below member 62 to hold the cover in place. Bag 60 is to occupy a particular position on the deck during sail changing. Thus, the edge of partition 63 adjacent which cover 71 is hinged should point toward the stern, and as seen in FIG. 15A, cover 71 is provided with position-indicating indicia, such as an arrow, visible when the cover is closed.

Compartments 68, 69 are each sized to contain one jibsail which has been furled and bagged according to the invention. Compartment 68 is to port when bag 60 is properly oriented on the fore deck and is equipped with two snap hook fasteners 73, 74 sewed to the wall of the bag immediately below member 62 in the area adjacent the forward edge of partition 64. Starboard compartment 69 is similarly provided with two snap hook fasteners 75, 76. Used for changing sails, bag 60 will normally contain the one of two jibsails not in use. As viewed in FIG. 15, compartment 69 contains a sail 77 which has been furled and bagged according to the invention, the tack cringle of the sail being secured to fastener 75, the furled and bagged sail extending downwardly from fastener 70 to the bottom of compartment 69, then being wound upwardly in generally helical fashion, and the head cringle being secured to fastener 76. Elastic safety cords 78 are secured to body 61 near the top of the bag so the bag can be attached to, e.g., the life lines.

Figure 10:
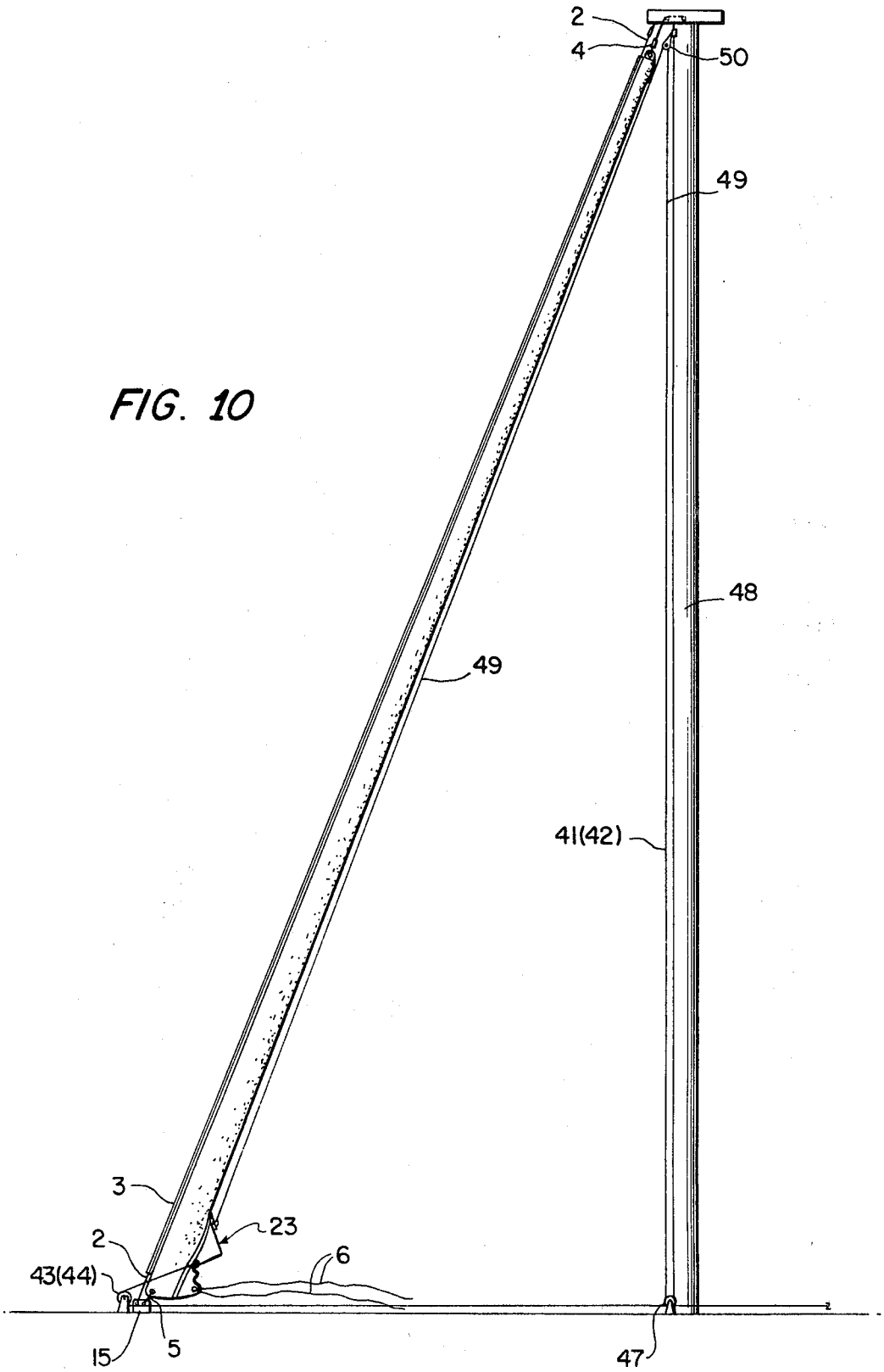
Figure 11:
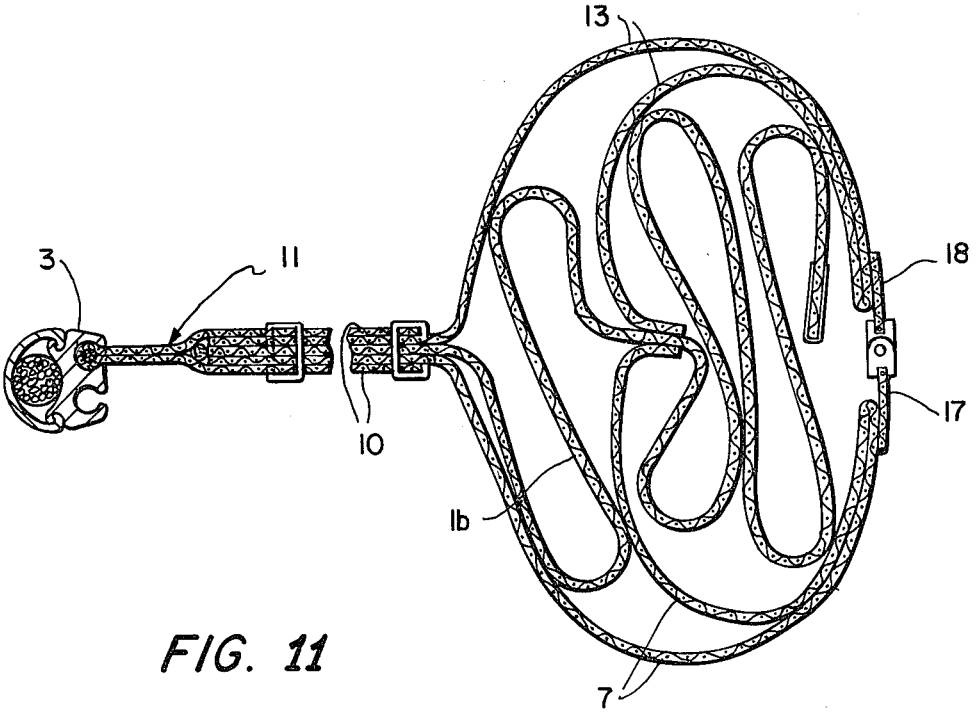
FIGS. 11–13 are semidiagrammatic cross-sectional views taken generally on lines 11—11, 12—12 and 13—13, FIG. 9, respectively, and enlarged relative to that figure.
Figure 16:
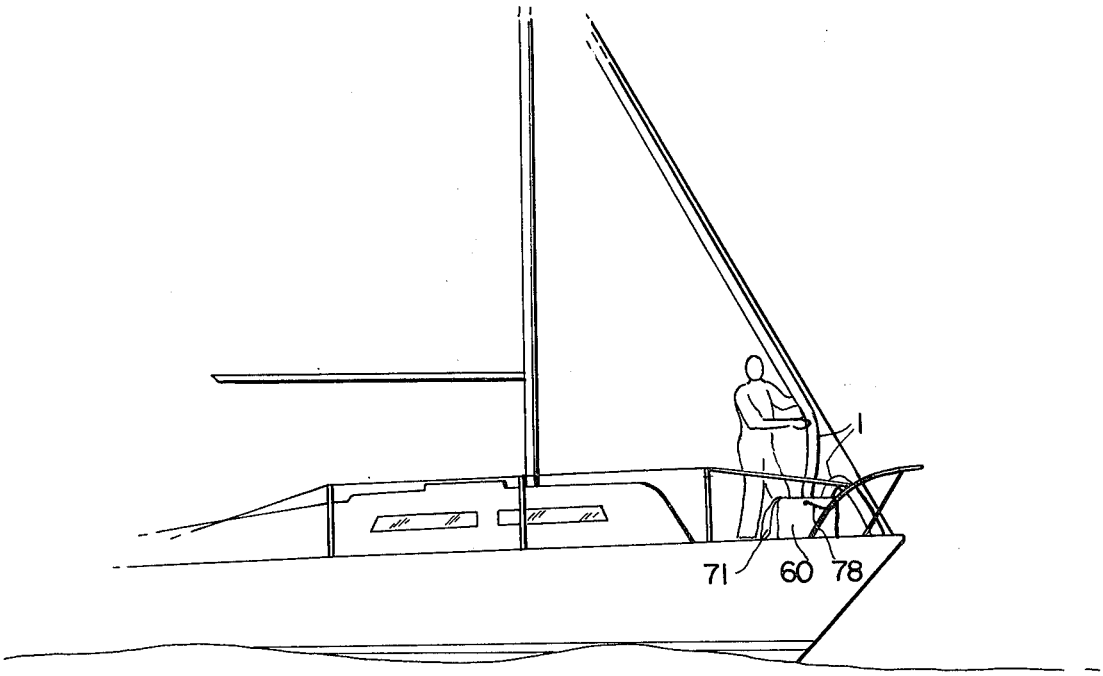
FIG. 16 is a perspective view illustrating the manner in which the sail of FIG. 1, once furled and bagged aloft, can be lowered and stowed in the bag shown in FIG. 15.

When the sail which is aloft and has been furled in the manner seen in FIG. 10, is to be replaced by sail 77, bag 60 is carried to the fore deck and placed on the deck immediately behind the headstay with the portion of the bag to which fasteners 73–76 are attached directed forwardly. Ring 20 is detached from fastener 21, freeing furler 23 from the sail. The sheets are disconnected and the halyard slacked. With the tack of the sail still secured, the remainder of the bagged sail is pulled downwardly and inserted, generally in a helical fashion, into compartment 68 of bag 60, as illustrated in FIG. 16. The tack is then unhooked and attached to fastener 74. When the head of the sail is reached, the halyard is detached and the head of the sail attached to fastener 73 while retaining the halyard in one hand. The head of sail 77 is then detached from fastener 76 and secured to the halyard, and hook 66*b* is detached from eye 70 and attached to eye 70*a*. The boltrope of the luff tape of sail 77 is fed into the groove of the lowermost extrusion 3 in usual fashion. The tack of the sail is then detached from fastener 75 and secured by tack hook 5. The halyard is then pulled to hoist sail 77. Ring 20 of the fastener runner of sail 77 is then attached to fastener 21 to secure furler 23 to the sail. The sheets are then attached to the clew of the new sail. Cover 71 of bag 60 is secured and the bag, with sail 1 properly stowed, is taken below. Unfurling line 49 is pulled to pull travelling furler 23 upwardly until the runner of the fastener of the sail reaches the permanently closed end of the fastener at the head of the sail. As furler 23 moves upwardly, the sail is released and set automatically.

Figure 17:
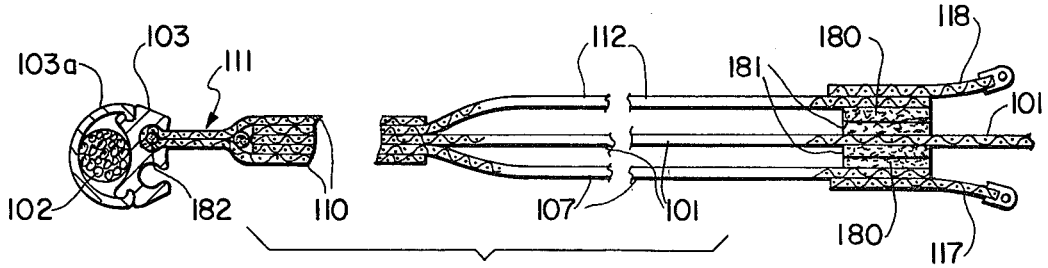
FIG. 17 is a fore-to-aft semidiagrammatic cross-sectional view of a sail according to another embodiment of the invention.
Figure 18:
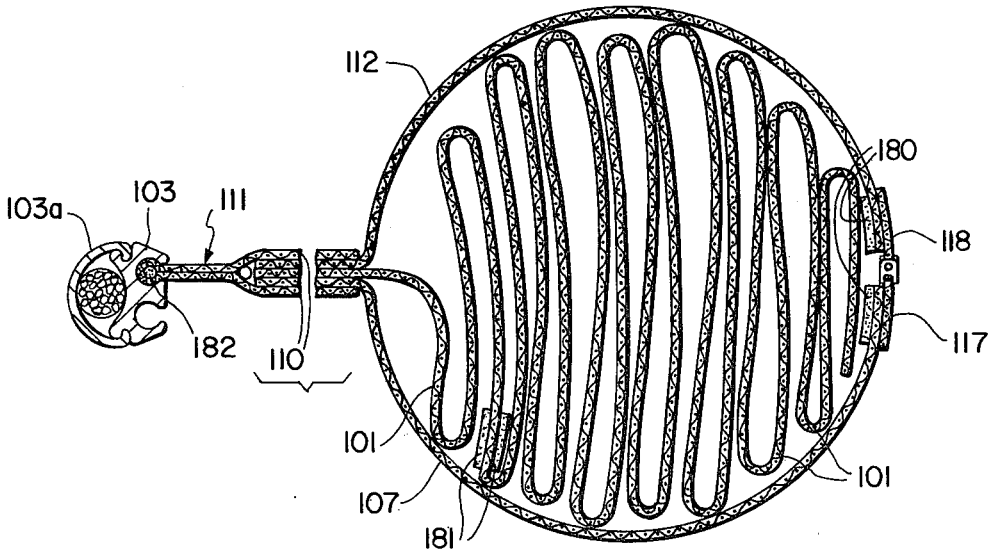
FIG. 18 is a cross-sectional view of the sail of FIG. 17 when furled and bagged.

THE EMBODIMENT OF FIGS. 17 and 18

In this embodiment, the elongated bag into which the sail is furled is formed from two added pieces of flexible sheet material. The body and reinforced head portion of sail 101 can be identical to sail 1, FIGS. 1–14. The bag to contain the furled sail results from the action of travelling furler 23, FIGS. 6 and 7, and is formed from two added portions 107 and 112 of flexible sheet material, each disposed on a different side of the sail, the leading edges of portions 107, 112 being coincident with the leading edge of sail 101 and disposed between the two trailing plies 110 of luff tape 111 so that, when the luff tape is sewed in place, the leading edges of the sail and portions 107, 112 are all secured to the luff tape. Leading boltrope 182 of the luff tape is engaged in the groove of headstay extrusions 103 and the sail and portions 107, 112 and thus secured to stay 102 by extrusions 103, 103*a* in conventional fashion.

Slide fastener tape 117 is secured to the trailing edge of portion 107, and fastener tape 118 is secured to the trailing edge of portion 112. The fore-to-aft dimensions for portions 107, 112 are determined as described for dimension b, FIG. 14. The fastener includes a runner (not shown) the same as runner 19 for sail 1, FIGS. 1–14. The runner is detachably connected to furler 23 by fastener 21. As described with reference to sail 1, the slide fastener is permanently closed at the head end of the sail. Pulling furler 23 downwardly also pulls the fastener runner downwardly, in the manner described with reference to sail 1. Thus, pulling furler 23 downwardly causes the sail to be furled progressively from head to foot and also causes tapes 17, 18 to be joined progressively to secure portions 107, 112 as an elongated bag containing the furled sail, as shown in FIG. 18.

Though the trailing edges of portions 107, 112 can be left free during sailing, it is advantageous to secure the trailing edges of portions 107, 112 to the sail releasably. This can be accomplished by means of conventional hook-and-loop fabric fastening means, e.g., the type available under the trademark VELCRO and generally described in U.S. Pat. No. 3,009,235, issued Nov. 21, 1961, to de Mestral. Thus, a plurality of patches 180 of hook fabric can be secured along the inner face of the trailing edge portions of portions 107, 112 and a like number of patches 181 of loop fabric can be secured to each surface of sail 101, with the locations of the patches selected so that each patch of hook fabric is opposed to a patch of loop fabric. When the sail is first set, the respective patches 180 engage patches 181 and are releasably secured, as a result of pressure caused aerodynamically, so that portions 107, 112 cannot flutter. However, when travelling furler 23 is pulled downwardly, the furler arms force portions 107, 112 away from the sail, disengaging patches 180 from patches 181.

In this embodiment, both portions 107, 112 are advantageously made from material resistant to ultra-violet light and other weathering effects.

MAINSAIL EMBODIMENT OF FIGS. 19–25

Figures 20, 20A:
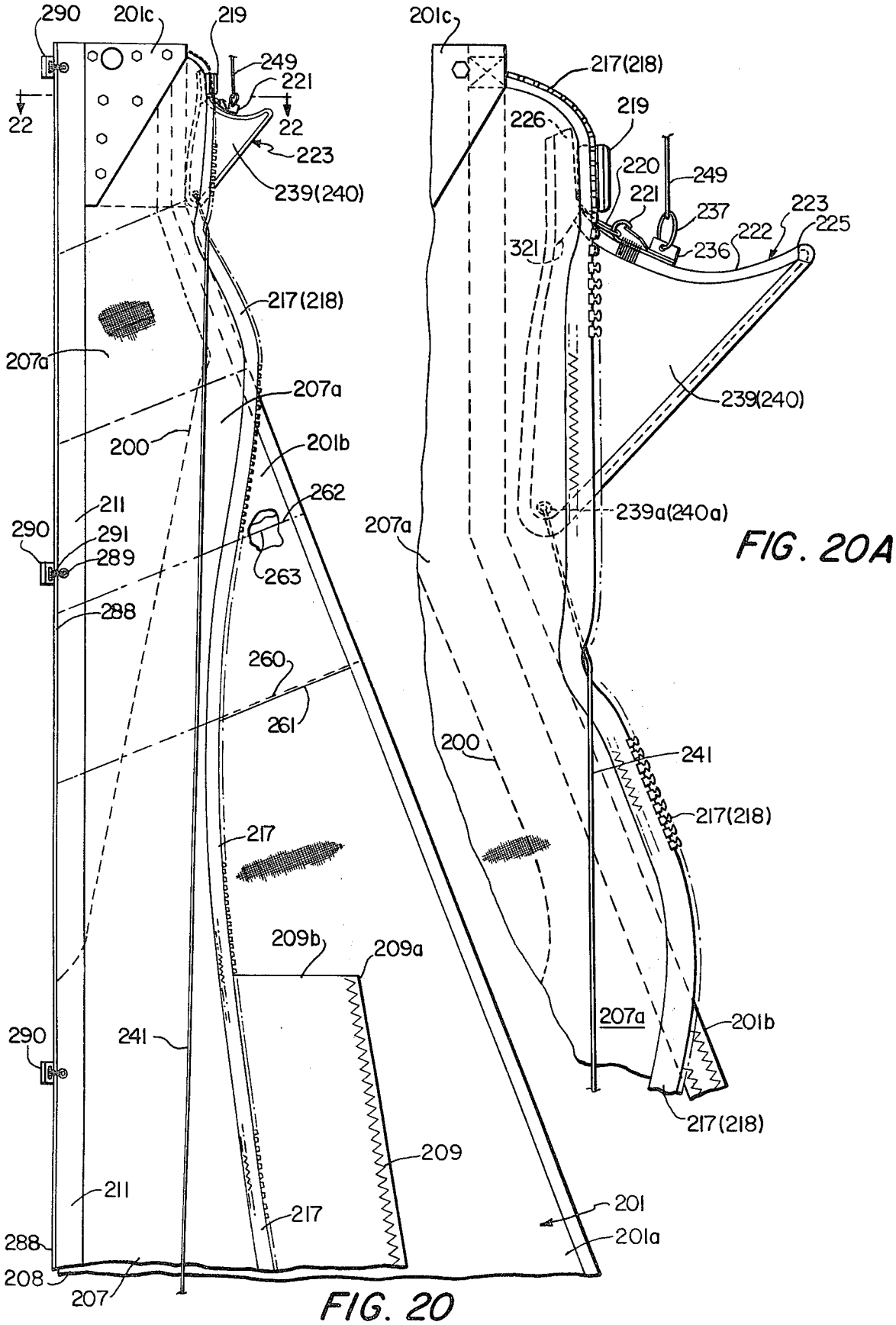
FIG. 20 is an enlarged side elevational view of the head portion of the sail of FIG. 19.
FIG. 20A is a fragmentary side elevational view of a part of the head portion of FIG. 20, enlarged with respect to that figure.

In this embodiment, mainsail 201 comprises a hollow-leech loose-footed sail body 201*a*, a reinforced head portion 201*b* and a headboard 201*c*. Reinforced portion 201*b* extends downwardly for a short distance, typically 2½ ft. for a 140 sq. ft. sail having a 29 ft. leading edge. The fabric of the main body 201*a* extends to the head, terminating at the upper edge of the headboard. Commencing at panel seam 260, FIG. 20, which defines the foot of reinforced portion 201*b*, a second piece of fabric 261 overlies the port side of the sail throughout portion 201*b*. Commencing at the next upper seam 262, a third piece of fabric 263 overlies the starboard side of the sail throughout portion 201*b*. Fabric pieces 261, 263 are of the same plan shape and dimensions as the corresponding portions of the reinforced area, so the leading and trailing edges of the three plies are coincident throughout their extent in reinforced head portion 201*b*. As seen in FIGS. 20 and 20A, the leech at the head of the sail extends downwardly vertically, parallel to the luff, for a distance approximately equal to the length of the leading edge of the headboard, then slants downwardly and aft to the clew. Headboard 201*c* includes two metal plates 285, FIG. 22, disposed each on a different side of the head of the sail and secured together, as by bolts, to clamp the head of the sail between the plates. The headboard is generally triangular, one side being parallel to the leading edge of the sail, a second extending horizontally, the third slanting downwardly and forwardly. The headboard is small, typically four or five inches along the horizontal side.

An additional portion of flexible sheet material 207, FIGS. 20 and 21, overlies the port side of sail body 201*a* and has its leading edge 208 coincident with the entire leading edge of the sail and its trailing edge 209 sewed to the sail from a point 209*a* spaced, e.g., one foot below seam 260, to the foot of the sail. A luff tape 211 having trailing plies 210 is employed, leading edges 208 and 286 and the leading edge of sail body 201*a* being disposed between plies 210 and secured by zig-zag stitching. At point 209*a*, the trailing portion of portion 207 stops at a straight horizontal edge 209*b* which extends forwardly for slightly less than half of the width of portion 207 at point 209*a*. A portion 207*a* of portion 207 extends upwardly from the location of horizontal edge 209*b*. The trailing edge of portion 207*a* is at first parallel to the luff, then curves upwardly and aft to the leech of reinforced portion 201*b* in a location, e.g., 8 in. below the bottom of headboard 201*c*, then following the leech, and then departing from the leech along a straight vertical line spaced, e.g., 1.5 in. aft of the leech, as best seen in FIG. 20A.

A second additional portion of flexible sheet material 212, FIG. 21, overlies the starboard side of sail 201, the leading edge 286 of portion 212 extending along the entire leading edge of sail 201, the trailing edge of portion 212 extending along a line spaced forwardly from the traling edge of portion 207, below point 209*a*, by a distance slightly less than half the width of portion 207. Above point 209*a*, portion 212 extends upwardly over head area 201*b* and has the same plan configuration and dimensions as does portion 207*a*.

One tape 217 of a conventional zipper type slide fastener extends over the outer surface of portion 207 and is sewed thereto, a weather-resistant cover strip 217*a* being secured over the tape by the same stitching. The second tape 218 of the slide fastener is sandwiched between the trailing edge 287 of portion 212 and the fabric of main body 201*a* of the sail, and trailing edge 287, tape 218 and the sail cloth are stitched together throughout the entire length of tape 218 below edge 209*b*. Above edge 209*b*, tapes 217, 218 follow and are sewed to the respective trailing edges of portion 207*a* and that part of portion 212 which extends across reinforced head portion 201*b* but are not sewed to the sail itself. Thus, from edge 209*b* upwardly, the trailing edges of the added fabric portions 207*a* 212*a* are not secured to the sail itself. The extreme upper ends of tapes 217 and 218 are, however, turned forwardly to overlap the sail, are sewed thereto with the teeth of the fastener permanently engaged (so the upper end of the fastener is permanently closed) and are clamped between the two plates 285 of the headboard. Both portions 207*a* and 212 are stitched to reinforced head portion 201*b* along a ine 200 commencing at the head and extending downwardly generally parallel to but spaced forwardly from the leech to the location where tapes 217, 218 cross the leech, at which point line 200 curves to slant downwardly and forwardly parallel to tapes 217, 218 until, after crossing seam 260, line 200 curves forwardly to cross the luff tape.

Figure 21:
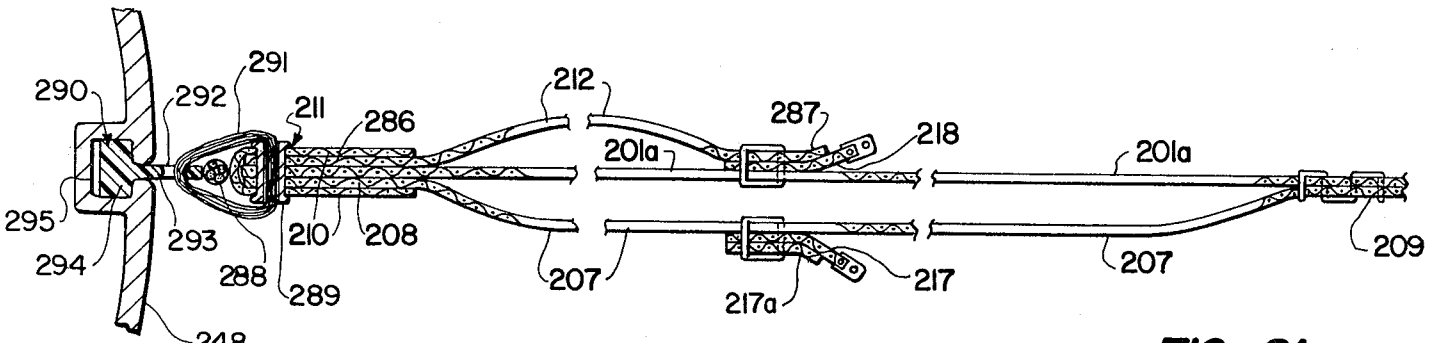
FIG. 21 is a cross-sectional view taken generally on line 21—21, FIG. 19.
Figure 22:
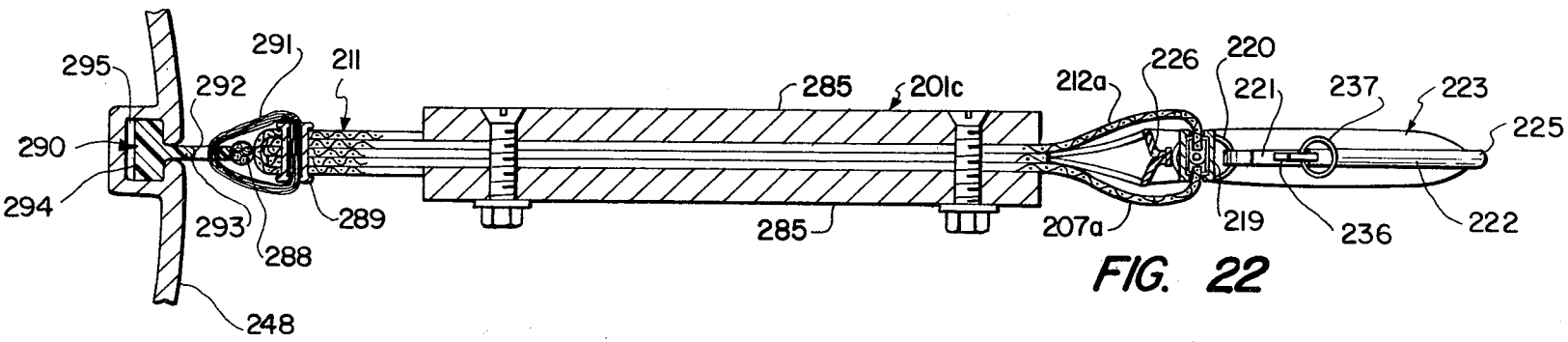
FIG. 22 is a cross-sectional view taken generally on line 22—22, FIG. 20.

The bight of tape 211 is sewed to a relatively heavy boltrope 288, FIGS. 21 and 22, which extends along the entire leading edge of the sail. A plurality of cringles 289 are applied to tape 211 at points spaced along the tape immediately adjacent rope 288. A plurality of slides 290 are spaced along rope 289, each slide being secured to the sail by flat waxed nylon lacing tape 291 laced through one of the cringles 289 and the opening 292 in the flange 293 of the slide. Slides 290 are conventional and include an elongated forward portion 294 slidably engageable in a longitudinal slot 295 in the mast 248.

The tack of sail 201 is hooked to boom mount 205 in conventional fashion. Boom 300 is a conventional hollow boom, connected to mount 205 by a conventional universal joint, and equipped with a longitudinally extending upper track 301, FIG. 19A, slidably retaining a clew slug 302 having a retainer 303 to which the clew cringle 304 is detachably connected by a snap shackle 305. An outhaul line 306 is detachably connected to the clew cringle by snap shackel 306*a* and extends outwardly, about outhaul sheave 307, thence through the interior of the boom toward the mast, exiting the boom via exit box 308 and being secured to a cleat 309 mounted on the boom. Between cleat 309 and the mast, a cheek block 310 is mounted on the boom. An extension 311 of the outhaul line runs from cleat 309 through block 310 and thence outwardly along the top of the boom and past clew slug 302 to be spliced to outhaul line 306 as shown. Halyard 204 is connected conventionally to headboard 201*c*, run upwardly and over a sheave in exit box 312, thence downwardly through the mast, exiting via exit box 313 to winch 314, and being secured on cleat 315. The boom is advantageously equipped with a boom topping lift line 316 connected to the free end of the boom and running to the masthead assembly, thence downwardly through the mast to exit via exit box 317 to be secured by cleat 318.

Figure 23:
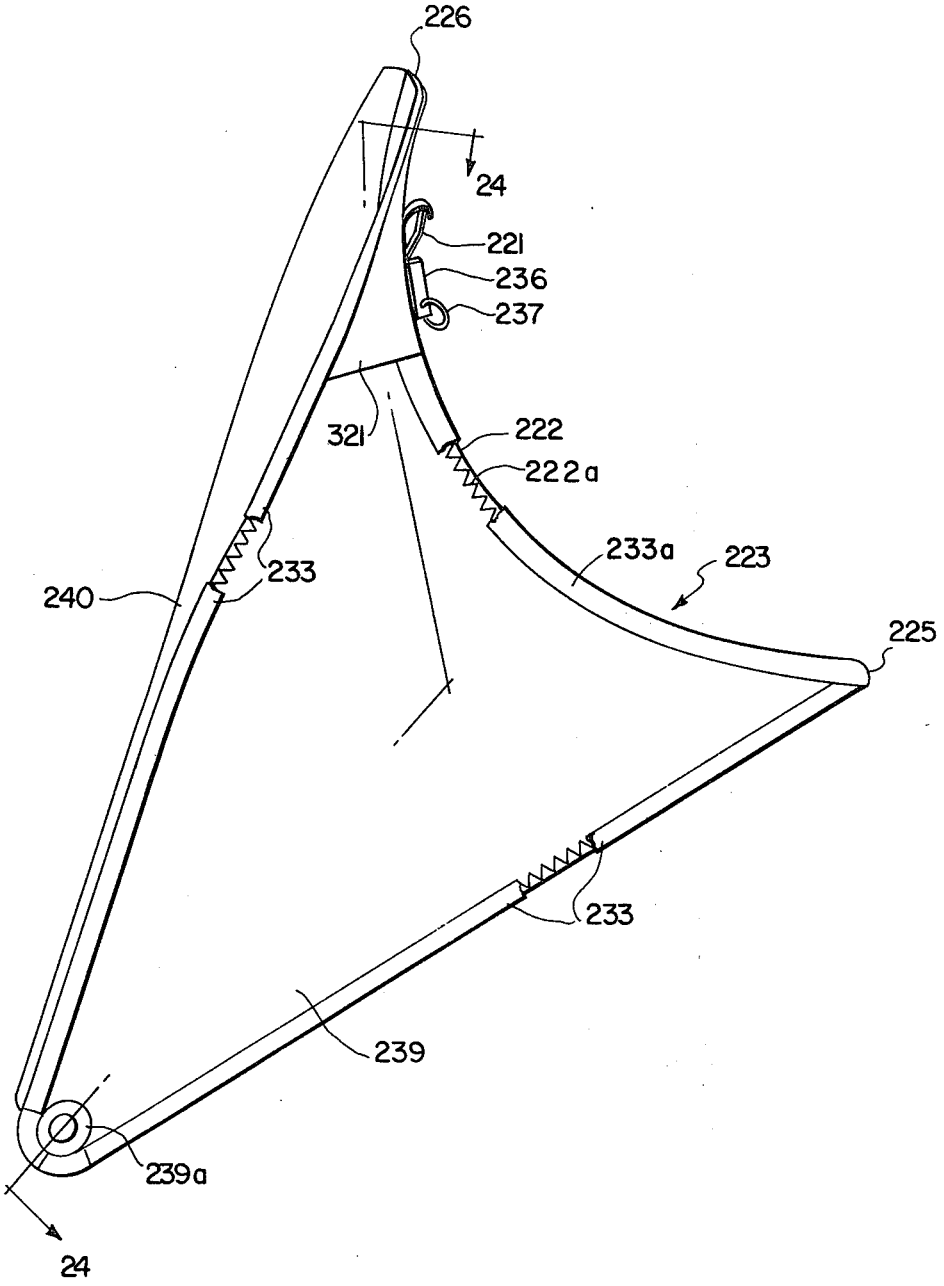
FIG. 23 is a perspective view of a travelling furler employed with the sail of FIGS. 20–22.
Figure 24:
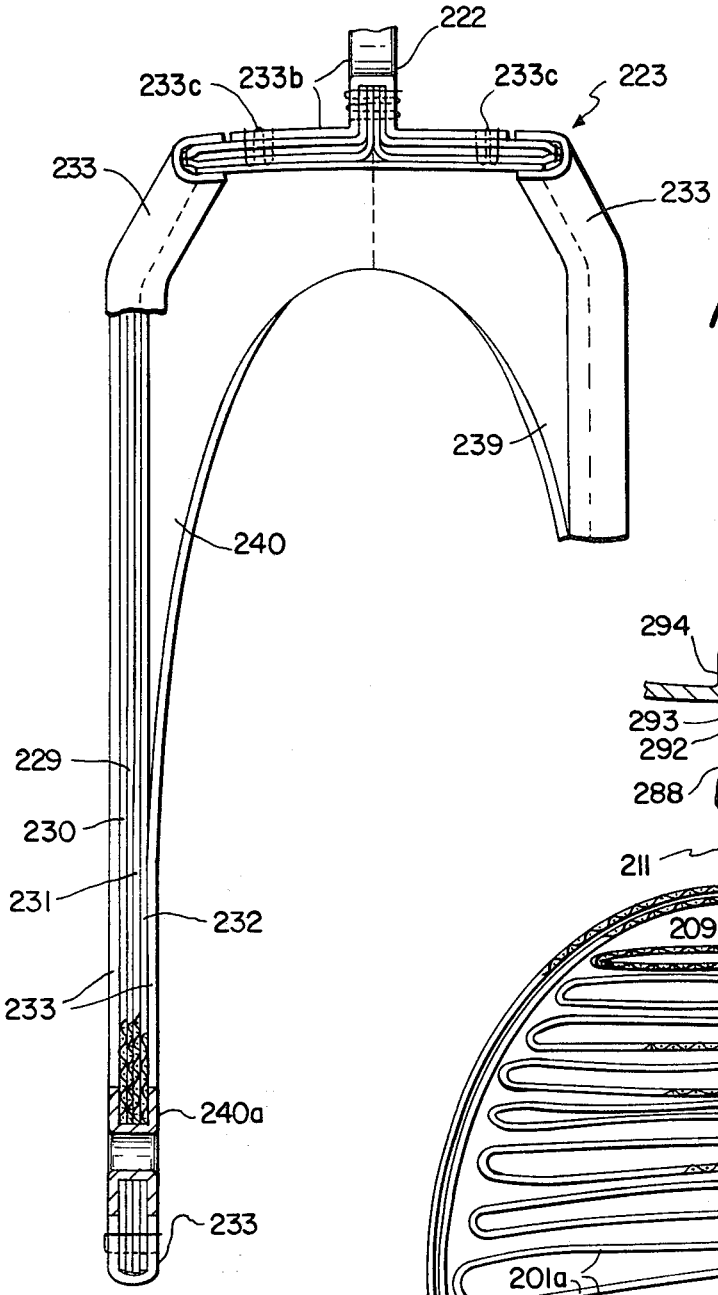
FIG. 24 is a transverse cross-sectional view taken generally on line 24—24, FIG. 23.

Travelling furler 223, shown in detail in FIGS. 23 and 24, is again a laminated fabric structure comprising an intermediate portion 222 from which two complementary arms 239, 240 depend. In this embodiment, the furler is assembled from two separate pieces, each constituting one of the arms 239, 240, the two pieces being sewed together along intermediate portion 222. As seen in FIG. 24, each arm 239, 240 is a laminated structure comprising an intermediate ply 229 of a material such as a cloth-backed vinyl sheet which will provide body and suppleness; outer and inner plies 230, 231 of a polyethylene terephthalate woven fabric or other material offering strength and controlled flexibility, and an inner surface ply 232 of, e.g., a woven nylon fabric presenting an uninterrupted low friction surface. Plies 229–231 are sewed together along lines distributed over the plan area of the piece. The assembly is secured by zig-zag stitching extending along the entire periphery. The edges of the arms which are to form intermediate portion 222 are curved, from trailing end 226 toward the ends of arms 239, 240 and thence back to leading end 225, and are sewed together in matched alignment, as by zig-zag sewing at 222*a*, FIG. 23. The long sides of arms 239, 240 are bound with elkhide at 233, sewed by straight line stitching extending through the peripheral portion of all of plies 229–232, thus securing all of the plies but leasing the exposed surface of inner ply 232 uninterrupted. For a major portion of the length of the curved edges, the sewed curve edges are bound with, e.g., a cloth-backed vinyl tape 233*a*, FIG. 23, the tape binding stopping short of trailing end 226 by, e.g., about one quarter of the length of the curved edges. The remaining portion of the sewed curved edges is bound by a piece of elkhide 233*b* sewed over the hem along the curved edges and extending over the adjacent outer surface portions of the respective arms. Elkhide piece 233*b* is sewed securely throughout the hem provided by stitching 222*a*, the portions of the two arms overlain by the free portions of piece 233*b* are then flattened so as to lie approximately in a common plane, and piece 233*b* is then sewed to the respective arms at points 233c, FIG. 24, while holding the leather piece and the arms smooth and flat. Then, when piece 233b is released, the trailing edges of arms 239, 240 flare apart, as seen by comparing FIGS. 23 and 24.

A snap hook 221, identical to hook 21 of FIG. 7, is lashed to intermediate portion 222 of furler 223 immediately adjacent elkhide piece 233b and is engaged by the connecting ring 220 of slide fastener runner 219 which is engaged with the fastener tapes 217, 218. Snap hook 221 includes an apertured plate 236 equipped with a ring 237 to which unfurling line 249 is connected. Two furling lines 241 and 242 are connected respectively to the cringles 239a, 240a of arms 239, 240 of furler 223 and extend downwardly each on a different side of the sail. Below the boom, lines 241, 242 are spliced at 249a to the unfurling line 249 which runs under sheave 247 into mast 248, thence upwardly through the mast to exit over sheave 260 and run downwardly to be attached to ring 237 on snap hook 221. Thus, as in the embodiment of FIGS. 1–14, the furling lines, the unfurling line and the travelling furler combine to form a closed loop such that the slack which would otherwise result from pulling the furling lines downwardly is taken up because downward movement of furler 223 pulls the unfurling line downwardly.

Sail 201 has the usual number of reefing points for a mainsail, each point including a reefing line 320, a tack cringle 321 and a clew cringle 322. Line 320 extends horizontally through a number of apertures in the sail, as shown, so that portions 320a lie on the port side of the sail and portions 320b on the starboard side. A plurality of reefing hooks 323 are secured to the port side of the sail, each centered on a different reefing line portion 320b. A plurality of reefing hooks 324 are secured to the opposite surface of the sail, each centered with respect to a different one of line portions 320a.

Added fabric portion 207 can be laid out generally as described for portion 7 of the embodiment of FIGS. 1–14. If sail 201 is of woven polyethylene terephthalate fabric having a weight of 6.5 oz. per sq. yd., the sailcloth constant can be taken as 1.7 times 6.5 or 11.05. Critical dimension D is taken by swinging an arc about the head through clew 304 and intersecting the leading edge, then measuring the chord of that arc from leading edge to trailing edge, a typical value for the mainsail being 10 ft. Then the width a of portion 207 along the chord is determined as $$a = \sqrt{10 \times 11.05 \times 3.1416} = 18.63 \text{ in.}$$

The dimension b to locate fastener tape 217 at the chord is $$b = 18.63/2 + 0.07 \times 9.31 = 9.97 \text{ in.},$$

using 7 as the constant T. Similarly, the dimension c along the chord from the seam of fastener tape 217 to the trailing edge of portion 207 is $$c = 18.63/2 - 0.07 \times 9.31 = 8.66 \text{ in.}$$

The width b of portion 212 at the chord is equal to that for portion 207. The second critical dimension D' can be determined at the location of edge 209b and dimensions a, b and c determined for that location, thus determining a second point for the straight trailing edge of portion 207 and a second point for the straight seam for fastener tape 217. If the sail is to have a curved luff, so that the trailing edges of portions 207, 212 must also curve, patterns can be employed as described with reference to the sail of the embodiment of FIGS. 1–14.

Figure 19:
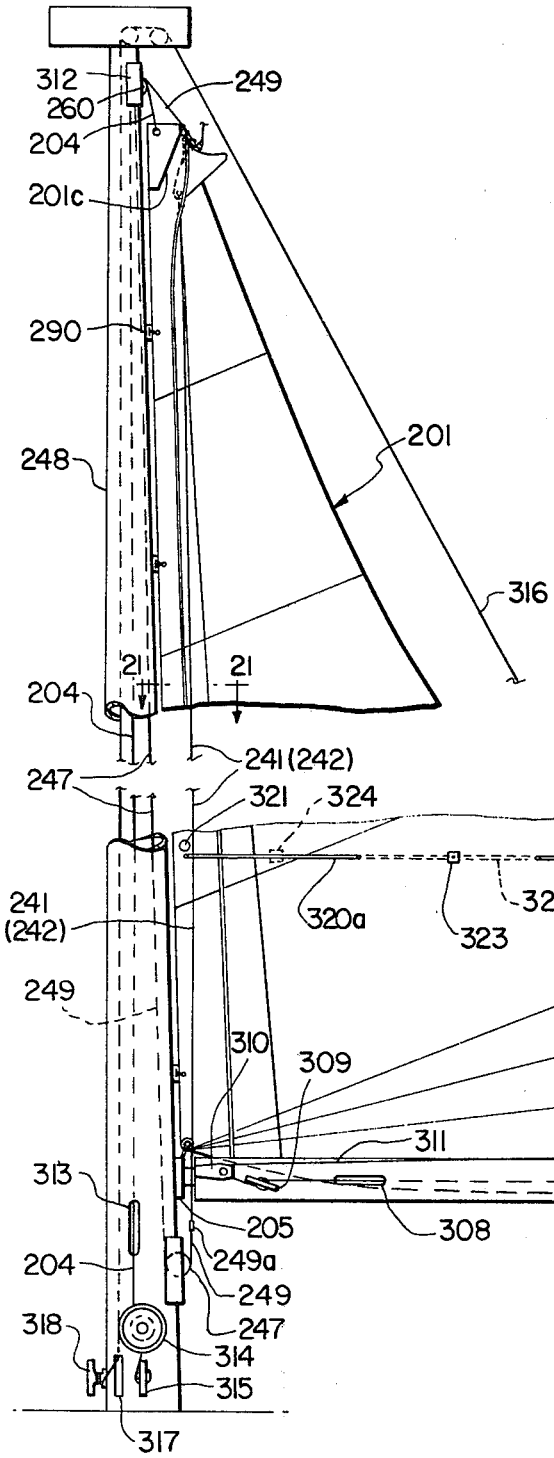
FIG. 19 is a semidiagrammatic side elevational view of a mainsail according to another embodiment.
Figure 19A:
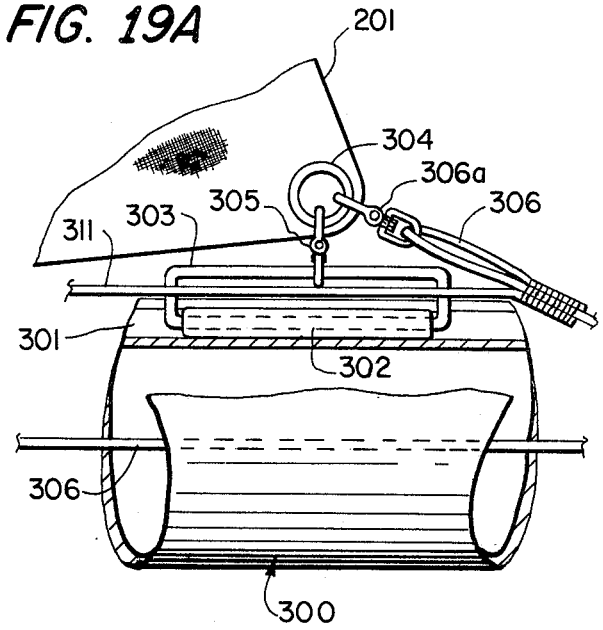
FIG. 19A is an enlarged fragmentary side elevational view, with portions broken away for clarity, of a part of the boom and sail of FIG. 19.
Figure 19A:
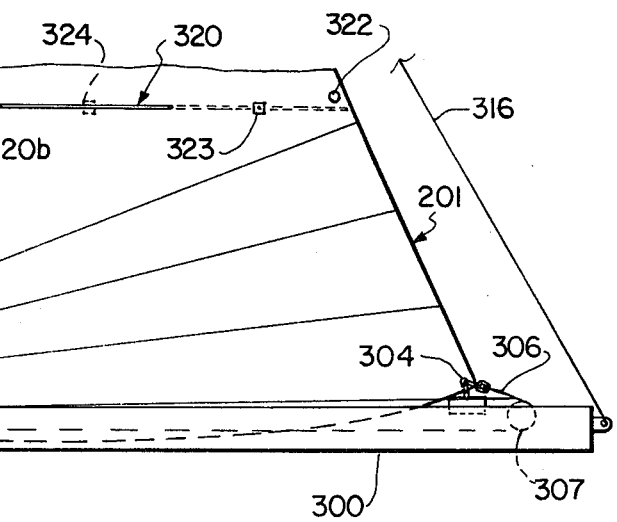
Figure 25:
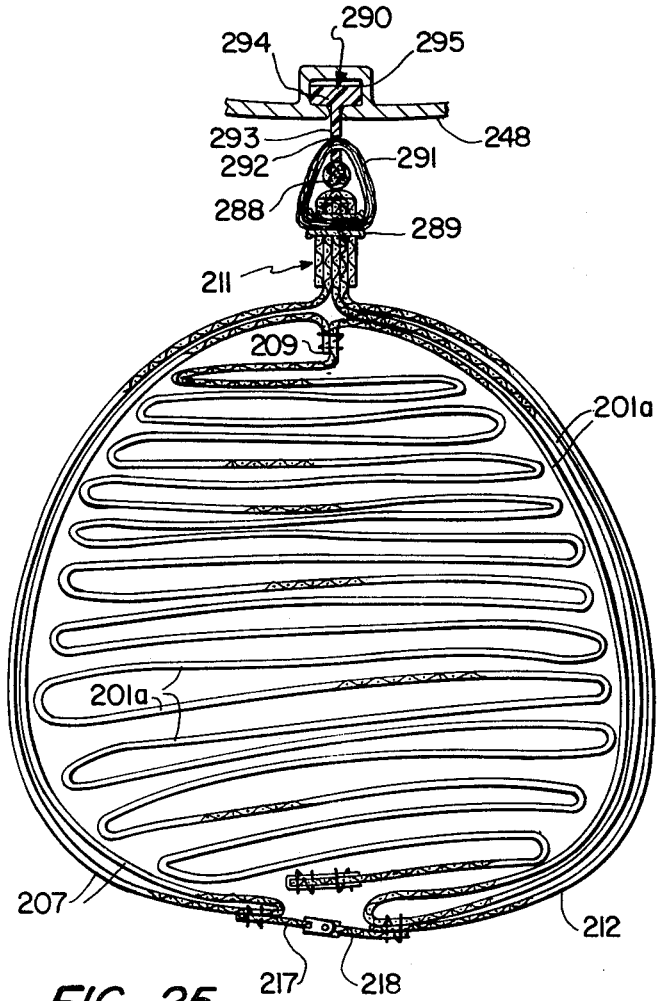
FIG. 25 is a cross-sectional view of the sail of FIGS. 19–22 when furled and bagged.

It will be apparent that, with the sail aloft and set as seen in FIG. 19, sail 201 can be furled and bagged, while aloft and still attached to the mast, in much the same manner described for the sail of FIGS. 1–14, simply by pulling furling lines 241, 242 downwardly. With the sail set, as in FIGS. 19–20A, the upper ends of fastener tapes 217, 218 are in their permanently closed condition, with runner 219 engaging both tapes and extending vertically from the closed ends, and travelling furler 223 is disposed with its trailing end 226 engaged between runner 219 and the vertical head of the leech of the sail and with the tips of arms 239, 240 engaged between fastener tapes 217, 218. Furling lines 241, 242 bend over tapes 217 and 218, respectively, as best seen in FIG. 20A, arms 239, 240 being held in tension between the furling lines and unfurling line 249. As furling lines 241, 242 are pulled, downward movement of furler 223 initially simply closes the slide fastener in a location aft of the leech and then begins to fold the aft portion of reinforced portion 201b forwardly, while continuing to pull runner 219 downwardly to close the fastener behind the furler. The aft portion of reinforced head area 201b is forced forwardly, against seam 200 and the bag defined by the parts of portions 207a, 212 which are aft of seam 200, as the slide fastener is progressively closed, and this action continues until furler 223 approaches horizontal edge 209b of portion 207. Commencing at that edge, fastener tape 218 is sewed to sail body 201a, and portion 207 is secured to the sail only at leading edge 208 and trailing edge 209. As the furler continues its downward travel over the leech, the seam between trailing edge 209 of portion 207 and sail body 201a is forced forwardly toward the leading edge of the sail, and as best seen in FIG. 25, the combined effect of the furler and slide fastener is to form an inner bag, defined by the aft part of portion 207 and the portion of sail body 201 between the seam at traiing edge 209 and the seam at fastener tape 218, and an outer bag, defined by the forward part of portion 207 and all of portion 212, the aft portion of the sail being folded into the inner bag, both bags being closed by the joined fastener tapes 217, 218. The sail is furled and bagged in the fashion seen in FIG. 25 from the location of edge 209b to the foot of the sail. As the sail is progressively furled and bagged, the clew must be released, so outhaul line 306 is released from cleat 309 and extension 311 is hauled toward the mast to cause slug 302 to move along track 301 toward the mast, thus moving the clew to the mast by the time that furler 223 approaches the foot. As furling and bagging of the sail is completed, the fact that the leech is longer than the luff causes some furled sail to extend below the lower end of the bag, but this furled but unenclosed portion can be easily inserted upwardly into the lower end of the bag as the last portion of the slide fastener is closed.

The furled and bagged sail can be left aloft, still secured to the mast by slides 290. In this connection, all of added fabric portions 207, 212, as well as strip 217a, can be of weather-and ultraviolet light-resistant fabric. The sail can be lowered simply by slacking the halyard and pulling the bagged sail downwardly.

MODIFIED EMBODIMENT OF FIG. 26

Figure 26:
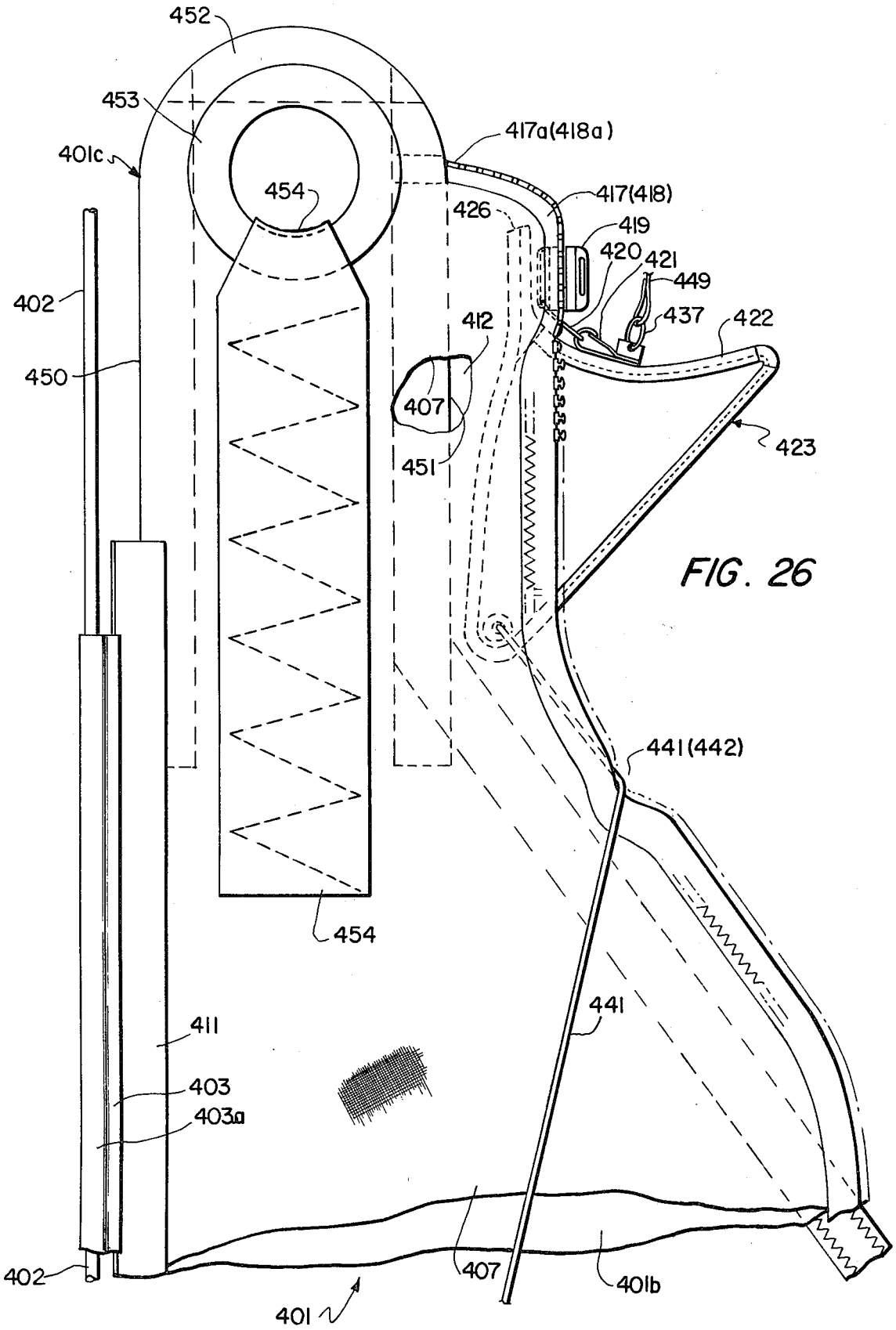
FIG. 26 is an enlarged side elevational view of a modified form of the jibsail of FIG. 1 adapted for use with the furler of FIGS. 23 and 24.

FIG. 26 shows the manner in which a jibsail, such as the sail of FIGS. 1–14, can be adapted to include a reinforced head portion generally like that of the mainsail embodiment just described and to employ the travelling furler of the mainsail embodiment. Here, reinforced head portions 401*b* can be made in any conventional fashion, the leading edge of portion 401*b* being sewed between the plies of luff tape 411 secured to headstay 402 by extrusions 403, 403*a* as hereinbefore described. The leech of reinforced head portion 401*b* terminates at a point spaced a small distance aft of the leading edge. At this point, a head extension 401*c* projects upwardly and is defined by a leading edge 450, which extends above but parallel to the leading edge of the sail body, a straight trailing edge 451 which is parallel to edge 450, and an arcuate end 452. Head cringle 453 is applied in conventional fashion and a heavy reinforcing tape 454 is run through the cringle and downwardly over each side of extension 401*c* and onto head portion 401*b*, being secured by stitching as shown. The trailing edge of added fabric portion 407 curves aft and crosses the leech a short distance below the juncture of the leech with trailing edge 451 of head extension 401*c*, then parallels the leech aft thereof, and then extends parallel to trailing edge 451 in a location spaced aft of edge 451. The trailing edge of the added fabric portion 412 on the other side of head portion 401*b* follows the same path just described for the trailing edge of portion 407. Slide fastener tapes 417, 418 follow and are sewed to the respective trailing edges of added fabric portions 407, 412. The extreme upper ends of the fastener tapes are joined at their ends 417*a*, 418*a* in permanently closed fashion and extend forwardly to be sewed to the trailing edge portion of extension 401*c* adjacent the head cringle.

Furler 423 is identical to furler 223 of the mainsail embodiment and is therefore equipped with a snap hook 421 to which the slide fastener runner 419 is connected by ring 420 and to which unfurling line 449 is permanently connected by ring 437. When the sail is aloft and set, furler 423 occupies the uppermost position seen in FIG. 26, with its trailing end portion disposed between runner 419 and head extension 401*c* and, therefore, enclosed between portions 407*a* and 412. The tips of arms 439, 440 are disposed at the leech between fastener tapes 417 and 418, with the furling lines 441, 442 bending outwardly across the toothed edges of tapes 417 and 418, respectively, and then running downwardly each on a different side of the sail.

Simultaneous furling and bagging of sail 401 is accomplished as described for the embodiment of FIGS. 19–25. When furled and bagged, the sail can be lowered, stowed and again installed as described with reference to FIGS. 1–15A.

EMBODIMENT OF FIGS. 27–29

Figure 27:
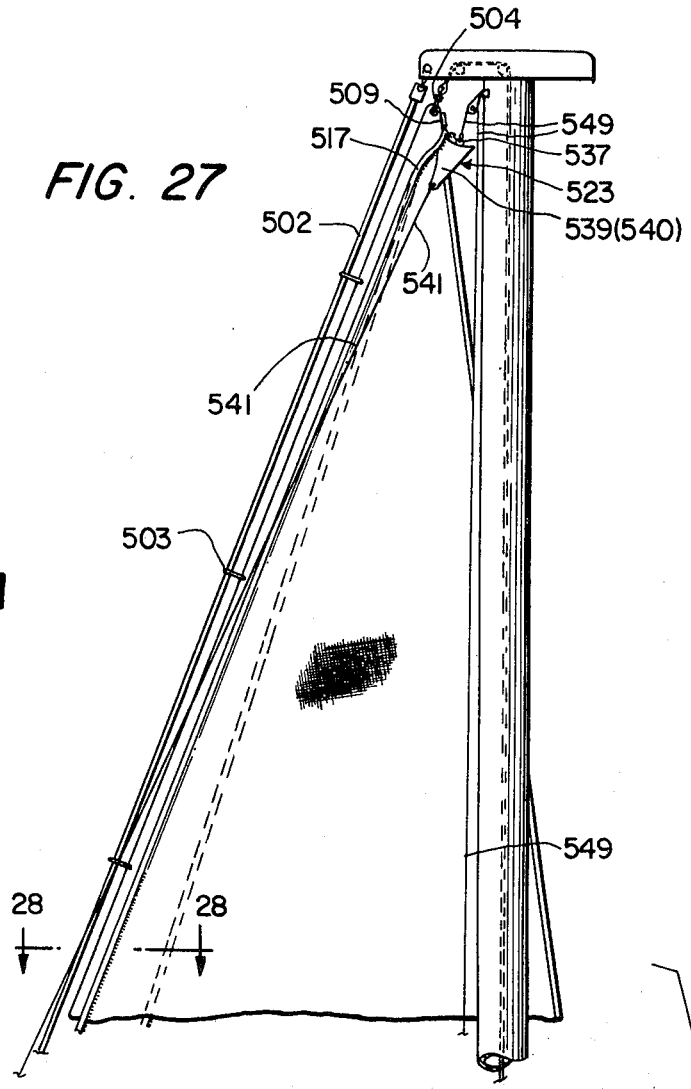
FIG. 27 is a semidiagrammatic side elevational view of a jibsail according to another embodiment.
Figure 28:
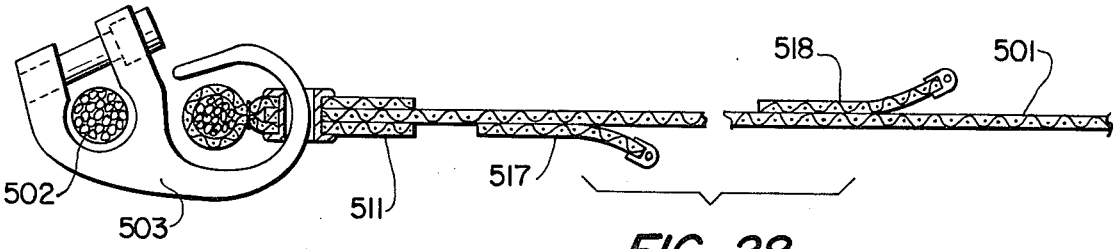
FIG. 28 is a cross-sectional view taken generally on line 28—28, FIG. 27.
Figure 29:
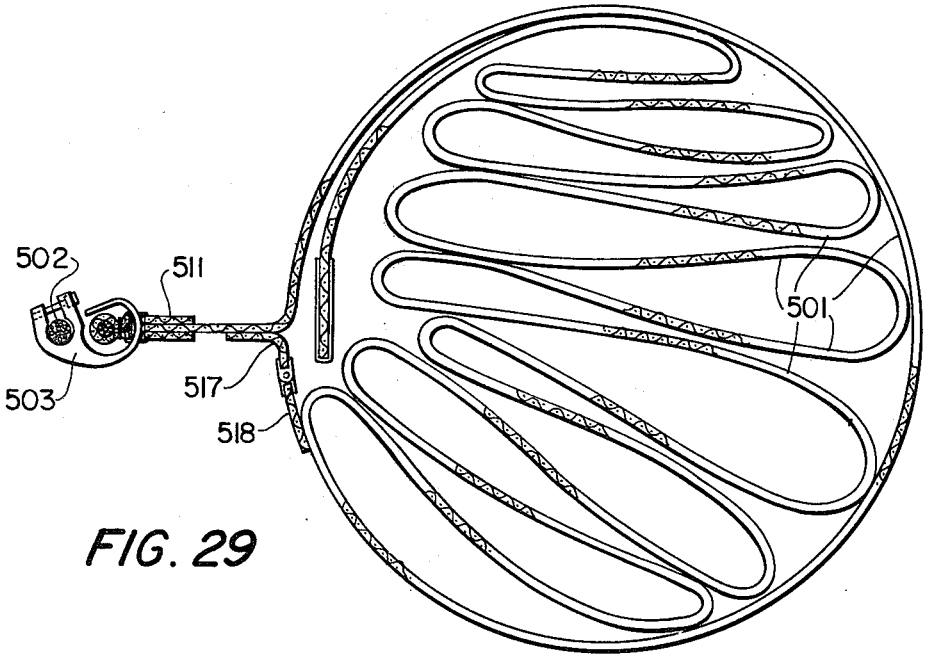
FIG. 29 is a transverse cross-sectional view of the sail of FIGS. 27 and 28 when furled and bagged.

The embodiment shown in FIGS. 27–29 differs from those described above in that the bag for containing the furled sail is formed from a portion of the sail itself, no added material corresponding to portion 7, FIGS. 1–14, or portions 207 and 212, FIGS. 19–25, being employed.

Jibsail 501 is of usual form, and the halyard 504 is attached to the head cringle, the tack is secured by hook 505, sheets 506 are attached to the clew, and the luff is attached to headstay 502 by conventional hanks 503. A first separable fastener tape 517 of the zipper type is sewed directly to the port side of the sail along a line parallel and adjacent to the luff tape 511 and extends from the foot of the sail almost to the head, curving aft just below the head, then crossing the leech and extending therealong to a point even with the head cringle. The second separable fastener tape 518 is sewed to the starboard side of the sail and extends along a line which commences at the foot in a location spaced aft of tape 517 and slants upwardly to become opposite to tape 517 at the upper end of the straight line portion of tape 517. Tape 58 then curves aft and follows the same line as tape 517. At their uppermost ends, the teeth of the two fastener tapes are engaged and the tapes sewed to the head of the sail to keep these ends permanently closed generally in the fashion earlier described for the tapes of FIGS. 20, 20A.

A travelling furler 523, similar to furler 223, FIGS. 19–25, is employed, ring 537 of furler 523 being connected to unfurling line 549 and arms 539, 540 of the furler being connected respectively to furling lines 541 and 542. The unfurling lines extend downwardly around sheave 543, thence rearwardly to the cockpit. Unfurling line 549 extends downwardly adjacent mast 548 and is joined to the ends of the furling lines, a sheave 547 being provided so that the furling lines can run forwardly from the cockpit and under that sheave to join the unfurling line (when the travelling furler is at the head of the sail).

Figure 27A:
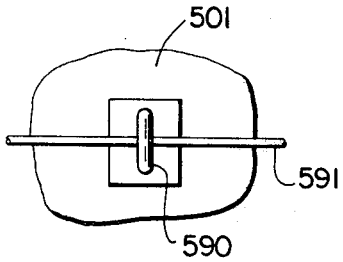
FIG. 27A is an enlarged fragmentary side elevational view of a pre-furling line and ring arrangement employed in the sail of FIG. 27.
Figure 27A:
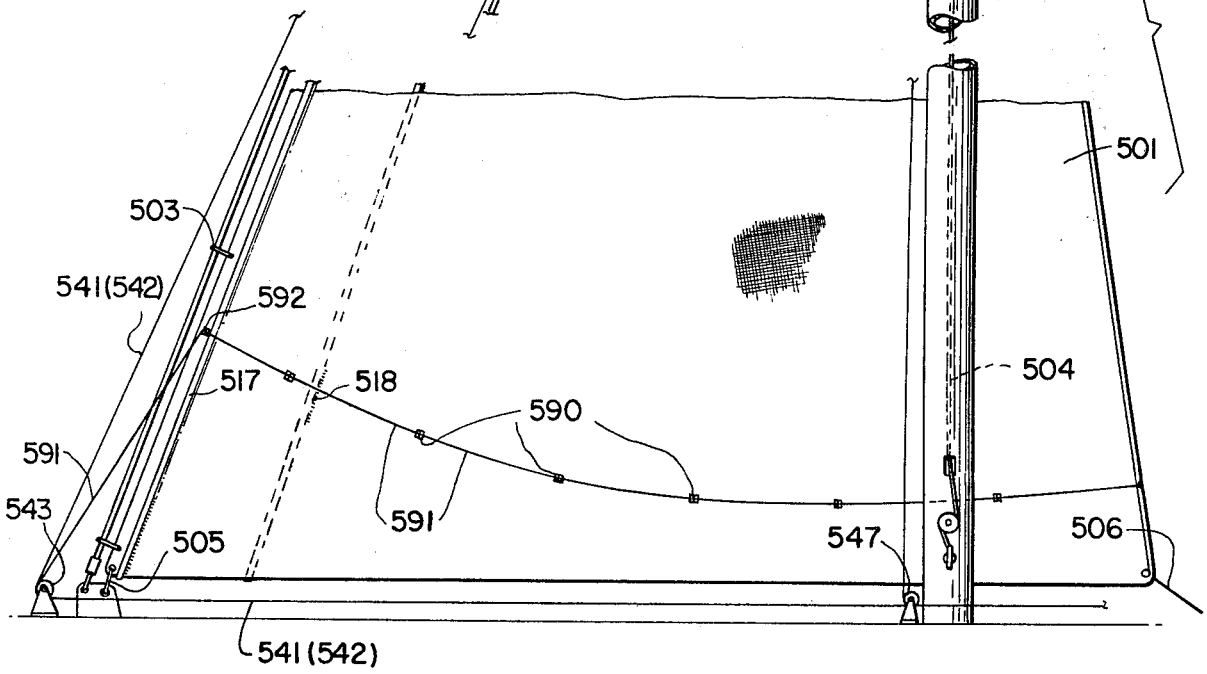

In this embodiment, the sail is prefurled, while furler 523 is at the head of the sail or just commencing its downward travel. To provide for prefurling, a plurality of rings 590, best seen in FIG. 27A, are secured to one side of the sail along a line generally parallel to the foot, the rings being spaced apart equally as seen in FIG. 27, and a furling line 591 being run through all of the rings and secured to the leech. An additional ring 592 is secured to the luff tape, and line 591 extends through this ring, about sheave 543, thence aft to the cockpit. The sail is prefurled simply by hauling in on line 591 from the cockpit so that the leech of the sail is brought forwardly until all of the rings 590 are side-by-side and the material of the sail between each adjacent pair of rings is disposed in a fold or flake running head-to-foot in direction.

The sail thus having been prefurled, furling lines 541, 542 are now pulled to move furler 523 downwardly. The furler acts to finally furl the sail and to bring the runner 519 of the separable fastener downwardly to progressively connect the two fastener tapes 517, 518. At the start of its downward travel, the upper or trailing end of the intermediate portion of the furler is engaged between the permanently closed end portions of tapes 517, 518 and the leech at the head of the sail. Since runner 519 follows the furler, the trailing end of the furler continues to lie inside the closing fastener tapes, while the arms 539, 540 of the furler embrace the prefurled sail. The portion of the fabric of the sail lying between tapes 517 and 518 is thus caused progressively to embrace the furled sail as the runner 519 progressively closes the separable fastener behind the furler, so that the entire sail is furled and bagged in the general fashion shown in FIG. 29.

Though this embodiment is illustrative of the scope of the invention, it lacks some of the special advantages of the embodiments described earlier. Thus, prefurling is desirable to make certain that the fabric of the sail cannot become enmeshed in the slide fastener, and prefurling can cause problems under some conditions of wind since the folds of the prefurled sail tend to billow in the wind and thus impede the action of the travelling furler. Similarly, in this embodiment, the travelling furler cannot simply follow the leech in straight line fashion, but rather must follow the path determined by tape 517 in order to bring the portion of the sail between the two tapes around the furled sail. It will be apparent that the portion of the sail between tapes 517, 518 can be of cover fabric, i.e., a cloth resistant to weathering and to ultraviolet light. Also, in this embodiment, it is possible to employ as the separable fastener a zipper tape slide fastener of the kind in which runner 519 can be run off the ends of the tapes as the fastener is closed. Then the sail can be prefurled by the action of line 591, furler 523 then manually put in place at the foot end of the sail, with fastener tapes 517, 518 being brought together by hand and runner 519 engaged with the tapes by hand, and the sail then being finally furled and bagged by pulling line 549 to cause the furler and runner to move upwardly, from foot to head, until runner 519 runs off the closed upper ends of the two fastener tapes.

FURLER EMBODIMENT OF FIGS. 30–32

When an elongated flexible fastener is employed which is of the type which can be run off the ends of the closed fastener tapes, a combined travelling furler and fastener slide of the type exemplified by FIGS. 30–32 can be used. Here the main body 622 of furler 623 is of metal or rigid polymeric material and the fastener runner 619 is integral with or rigidly secured to the trailing end portion 626 of body 622. Recognizing the position seen in FIG. 30 as the normal position of the device when at the head of the sail, say in the embodiment of FIG. 26, body 626 curves longitudinally, downwardly and away from the position to be occupied by the leech of the sail, ending in the rounded tip 625. Throughout at least most of its length, body 626 is of generally U-shaped transverse cross section, as seen in FIG. 32, so that in effect the body includes two arm portions 639, 640 which project away from that side of body 622 occupied by runner 619. Arm portions 639, 640 are not of as great extent as the arms 39, 40 of furler 23, FIGS. 5–7, and for this reason are supplemented by the end portions 641, 642 of the furling lines, those lines being run through openings **622*a* and 622*b*, respectively, in arm portions 639, 640. End portions 641, 642 of the furling lines are encased in polymeric tubing 641*a* and 642*a*, respectively, for a short distance to increase the area of surface engagement between these line portions and the sail being furled. In this embodiment, ring 637 for attachment of the unfurling line (not shown) is connected directly to fastener runner 619**.

PRACTICE OF THE INVENTION TO ASSIST REEFING

The method and said system of the invention can be employed to assist in reefing the sail, whether the sail is, e.g., a mainsail or a jibsail.

Considering the mainsail embodiment of FIGS. 19–25, the sail is first furled and bagged as described above, the line extension 311 being hauled in to cause clew slug 302 to travel along track 301 to a position near the mast. Boom topping lift line 316 is pulled to raise the free end of the boom slightly and the topping lift line is resecured to cleat 318. Unfurling line 249 is pulled down to raise furler 223 just far enough to expose clew cringle 322, track cringle 321 being exposed at all times. Halyard 204 is slacked, new tack cringle 321 is pulled down to the boom, the tack cringle last used is unhooked from boom mount 205 and new tack cringle 321 is hooked to the boom mount. Outhaul line 306 is detached from the original clew and reattached to new clew cringle 322 by snap shackle **306*a*. The snap shackle 305 of the clew slug is detached from cringle 304 and reattached to new clew cringle 322. All of the operations just described can be accomplished by one person standing at the mast since, at the time the sail was furled and bagged, clew slug 302 was pulled to the mast by manipulating line 311. The reefed sail is now unfurled and set simply by hauling on unfurling line 249 until travelling furler 223 reattains the uppermost position shown in FIG. 19. Now leaving the mast for the first time, the person who has accomplished the tasks just described moves along the boom, hooking the alternate portions of reefing line 320 about reefing hooks 323 and 324, respectively, with each line portion 320*a* and 320*b*** extending around the reefed portion of the loose footed sail.

Though the method and sail system can be used to assist more conventional reefing, as when the original clew is permanently attached to the clew slug and, when the outhaul line is reattached to the new clew, the line is run through a snatchblock on the boom and no slug is employed for the new clew, the procedure and system described above is particularly advantageous because it minimizes the need for additional reefing hardware and maximizes the work that can be accomplished during reefing without moving away from the mast.

Reefing of jibsails according to the invention differs from reefing the mainsail in that, for a jibsail, the sheets are slack at the time of furling and bagging the sail and the clew therefore is brought freely to the stay as the sail is furled and bagged, so that it is only necessary to secure the new track, reattach the sheets to the new clew, and secure in conventional fashion the excess sail below the new tack and clew.

What is claimed is:

1. The method for furling a working sail while the sail is aloft, the sail being of flexible sheet material, comprising providing flexible sheet material extending along the sail from head to foot and located aft of the leading edge of the sail;

at least preliminarily furling the sail from leech to luff while the sail is aloft and the leading edge of the sail is attached to a support;

progressively forming said flexible sheet material into a tubular bag the length of which extends between the head and the foot of the sail and progressively disposing the sail in fully furled condition within the tubular bag as the bag is formed and while the leading edge of the sail remains attached to the support, the step of progressively forming said flexible sheet material into a tubular bag and progressively disposing the sail in fully furled condition within the tubular bag as the bag is formed is carried out by engaging a travelling furler over the aft portion of the sail adjacent one of the head and the foot of the sail and moving the furler progressively over the aft portion of the sail in a direction extending between the head and the foot; and as the tubular bag is formed, progressively securing the bag against opening.

2. The method according to claim 1, wherein said flexible sheet material comprises a fore portion of the sail defined by a first line running from head to foot adjacent the leading edge of the sail and a second line running from head to foot aft of the first line; and the step of progressively forming said flexible sheet material into a tubular bag is carried out by bringing together linear portions of the sail material extending along said first and second lines.

3. The method according to claim 2, wherein the step of progressively securing the bag against opening is carried out by releasably securing said linear portions to each other as they are brought together.

4. The method according to claim 1, wherein the step of progressively securing the tubular bag against opening is carried out by progressively closing an elongated separable fastener comprising elongated fastener elements extending along said flexible sheet material from head to foot and a runner operative to cause interengagement of said fastener elements, the runner being connected to the travelling furler for movement therewith.

5. The method according to claim 4, wherein the separable fastener is so arranged that the runner closes the fastener when moved from head to foot and opens the fastener when moved from foot to head; and the steps of progressively securing the bag against opening and progressively disposing the sail in fully furled condition within the tubular bag are both accomplished by pulling downwardly on the furler.

6. The method according to claim 5 wherein the head of the sail is releasably attached to a halyard and the tack of the sail is releasably secured, the method further comprising providing at the foot of the furled and bagged sail a multiple compartment sail stowage bag containing in one of its compartments a second sail which has been furled and bagged by the method of claim 5 and which has a head adapted to be attached to the halyard and a tack adapted to be secured to a securing point;

detaching the furler from the sail which is still aloft;

slacking the halyard;

pulling a portion of the sail near the foot down and into an empty compartment of the stowage bag;

releasing the tack of the sail and attaching the tack to the stowage bag;

pulling the remainder of the sail down and into the compartment of the stowage bag;

releasing the head of the sail from the halyard;

attaching the head of the second sail to the halyard;

hauling the halyard to raise the second sail until the tack of that sail is at hand;

securing the tack of the second sail;

attaching the furler to the second sail at the foot thereof; and causing the furler to travel to the head of the second sail to free that sail.

7. The method defined in claim 1, wherein the furler includes an intermediate portion, engaged over the leech portion of the sail, and two arms extending from the intermediate portion and located each on a different side of the sail; and the step of progressively disposing the sail in fully furled condition within the tubular bag is carried out by maintaining the intermediate portion of the furler adjacent the closing point of a separable fastener as the fastener is progressively closed, said separable fastener comprising elongated fastener elements extending along said flexible sheet material between the head and the foot.

8. The method defined in claim 7, wherein the arms of the furler are flexible; and the steps of progressively securing the bag against opening and progressively disposing the sail in fully furled condition within the tubular bag are both carried out by pulling downwardly on end portions of the flexible arms of the furler to cause the flexible arms to slidably embrace and confine the aft portion of the sail as the sail is progressively furled.

9. The method defined in claim 8, wherein the separable fastener is of the type comprising a runner and is so arranged that the runner closes the fastener when moved in a direction from head to foot and opens the fastener when moved in a direction from foot to head; and the step of progressively disposing the sail in fully furled condition within the tubular bag is carried out with the intermediate portion of the furler engaging the sail in advance of the runner of the separable fastener.

10. The method defined in claim 8, wherein the separable fastener is of the type comprising a runner and is so arranged that the runner closes the fastener when moved in a direction from head to foot and opens the fastener when moved in a direction from foot to head; and the step of progressively disposing the sail in fully furled condition within the tubular bag is carried out to confine the furled sail in a compacted form spaced inwardly from the runner of the separable fastener.

11. The method according to claim 1 wherein the step of at least preliminarily furling the sail while the sail is aloft comprises first advancing the foot portion of the sail from the leech to the luff while pleating the sail from head to foot to preliminarily furl the sail, and then moving the furler over the preliminarily furled sail to complete furling.

12. The method according to claim 1, wherein progressive movement of the furler commences at the head and proceeds to the foot.

13. The method according to claim 12, wherein the sail is a headsail equipped with a halyard and sheets and having at least one reefing point with a secondary tack and a secondary clew, further comprising slackening the halyard after the sail has been furled and bagged;

opening the tubular bag from the foot of the sail upwardly until the secondary tack and secondary clew are exposed;

pulling the furled and bagged sail downwardly and securing the secondary tack while the portion of the sail thereabove remains furled and bagged;

attaching the sheets to the secondary clew;

tightening the halyard;

then opening the bag to the head of the sail to free the sail; and securing the portion of the sail below the secondary tack and clew.

14. The method according to claim 12, wherein the sail is a mainsail equipped with a halyard and an outhaul line and connected to a mast and a boom and having at least one reefing point with a secondary tack and a secondary clew, further comprising slacking the halyard after the sail has been furled and bagged;

opening the tubular bag from the foot of the sail upwardly until the secondary tack and secondary clew are exposed;

pulling the furled and bagged sail downwardly and securing the secondary tack while the portion of the sail thereabove remains furled and bagged;

attaching the outhaul line to the secondary clew while the secondary clew is held adjacent the mast because the sail above the secondary tack and clew remains bagged;

tightening the halyard;

then opening the bag to the head of the sail to free the sail and manipulating the outhaul line to pull the secondary clew outwardly to its working position; and securing the portion of the sail below the secondary tack and clew.

15. The method according to claim 14 wherein the clew of the sail is connected to the boom by a clew connector which is movable along the boom, further comprising moving the clew connector toward the mast as the sail is furled and bagged;

attaching the secondary clew to the clew connector; and moving the clew connector outwardly along the boom as the bag is opened to the head of the sail.

16. A working sail capable of being remotely furled and unfurled while aloft comprising, in combination flexible sheet material extending from the head to the foot of the sail;

elongated flexible fastener means comprising two elongated flexible fastener elements, and runner means operatively associated with the elongated flexible fastener elements to progressively close the fastener means when the runner means is moved in one direction and progressively open the fastener means when the runner means is moved in the other direction, each of the elongated fastener elements being secured to said flexible sheet material along a different linear portion thereof extending substantially from head to foot, the lateral extent of said flexible sheet material between said different linear portions being adequate to form a tubular bag capable of containing the sail when the sail is furled from leech to luff;

means for furling the sail comprising a travelling furler engageable over the aft portion of the sail and movable therealong;

first remotely manipulatable line means connected to the furler and the runner means of the separable fastener means for pulling the furler along the sail and pulling the runner means behind the furler to progressively form said flexible sheet material into a tubular bag enclosing the sail and secure the bag against opening; and second remotely manipulatable line means connected to at least the runner means of the separable fastener means for pulling the runner means in a direction to open the tubular bag preparatory to unfurling the sail.

17. The combination defined in claim 16, wherein the means for furling the sail further comprises means other than the travelling furler for prefurling the sail in advance of the travelling furler.

18. The combination defined in claim 16, wherein end portions of the elongated fastener elements at the head of the sail are secured in closed relation;

the first line means is arranged to pull the furler and the runner means downwardly from head to foot; and the second line means is arranged to pull the runner means and the furler in the opposite direction.

19. The combination defined in claim 18, wherein the furler comprises an intermediate portion engageable over the leech portion of the sail, and two arms extending from the intermediate portion each on a different side of the sail.

20. The combination defined in claim 19, wherein the first remotely manipulatable line means comprises two line portions each connected to a different arm of the furler.

21. The combination defined in claim 20, wherein the runner means of the separable fastener means is connected to the furler, whereby a downward strain applied by the first remotely manipulatable line means is also applied to the runner means.

22. The combination defined in claim 21, wherein the runner means is connected to the intermediate portion of the furler.

23. The combination defined in claim 22, wherein the runner means and the intermediate portion of the furler are portions of an integral unit.

24. The combination defined in claim 22, wherein the runner means is detachably connected to the intermediate portion of the furler.

25. The combination defined in claim 22, wherein the secondary remotely manipulatable line means comprises a line portion connected to the runner means and extending upwardly therefrom.

26. The combination defined in claim 25, wherein the upwardly extending line portion is also connected to the intermediate portion of the furler.

27. The combination defined in claim 22, wherein the arms of the furler are flexible; and the two line portions of the first remotely manipulatable line means are connected to the free ends of the arms.

28. The combination defined in claim 22, wherein the intermediate portion of the furler is of substantial length; and the two arms of the furler are of substantial width.

29. The combination defined in claim 28, wherein the furler is in the form of a relatively thin generally planiform body folded upon itself about said intermediate portion.

30. The combination defined in claim 29, wherein the arms of the furler each constitute substantially one-half of the generally planiform body and are generally triangular and taper away from the intermediate portion.

31. The combination defined in claim 29, wherein the body of the furler is laminated and the face of the body directed toward the sail is made up of flexible polymeric material.

32. The combination defined in claim 29, wherein the runner means is connected to the intermediate portion of the furler in a location spaced from the center of that portion toward the head; and the two line portions of the first remotely manipulatable line means are connected to the respective arms of the furler in locations spaced from the center of the intermediate portion toward the foot.

33. The combination defined in claim 29, wherein the intermediate portion of the furler extends in a substantially straight line.

34. The combination defined in claim 29, wherein the intermediate portion of the furler curves downwardly and aft.

35. The combination defined in claim 16, wherein said flexible sheet material is in addition to the sheet material of the sail and comprises
two elongated portions each having
a leading edge, and
a trailing edge portion,
each of the elongated portions being disposed on a different side of the sail and having its leading edge secured to the sail along the leading edge of the sail;
each of the elongated flexible fastener elements extending along and being secured to the trailing edge portion of a different one of the two elongated portions of said flexible sheet material.

36. The combination defined in claim 35 and further comprising
additional separable fastener means for releasably securing the trailing edge portions of the two elongated portions of said sheet material to the sail when the sail is unfurled and set.

37. The combination defined in claim 36, wherein the additional separable fastener means is of the hook-and-loop-fabric type and comprises coacting pairs of fastener members secured one to the sail and one to the respective trailing edge portion and being automatically engageable on light face-to-face contact.

38. The combination defined in claim 35, wherein the two elongated portions of said flexible sheet material are of material resistant to ultra-violet light.

39. The combination defined in claim 16, wherein said flexible sheet material comprises
a fore portion of the sail defined by the leading edge of the sail and a line spaced aft of the leading edge and extending from head to foot, and
an additional elongated portion having a leading edge and a trailing edge,
the leading edge of the additional elongated portion extending along and being secured to the leading edge of the sail,
the trailing edge of the additional elongated portion being secured to the sail along said line spaced aft of the leading edge of the sail;
one of the elongated flexible fastener elements being secured to said fore portion of the sail on the side thereof opposite said additional elongated portion;
the other of the elongated flexible fastener elements being secured to said additional elongated portion on the side thereof opposite said fore portion of the sail,
at least one of the elongated flexible fastener elements being spaced forwardly from the juncture between the trailing edge of the additional elongated portion and said fore portion of the sail,
the lateral extent of the flexible sheet material between the two flexible fastener elements and aft thereof being adequate to enclose the sail when the sail is furled.

40. The combination defined in claim 39, wherein both of the elongated flexible fastener elements are spaced forwardly from the juncture between the trailing edge of the additional elongated portion and said fore portion of the sail.

41. The combination defined in claim 40, wherein the lateral extent of the flexible sheet material between the two flexible fastener elements and aft thereof is significantly smaller than the lateral extent of the flexible sheet material between the two flexible fastener elements and forwardly thereof.

42. The combination defined in claim 16, wherein said flexible sheet material comprises
a first elongated portion disposed on one side of the sail and having a leading edge and a trailing edge portion,
the leading edge of the first elongated portion being secured to the sail along the leading edge of the sail,
the trailing edge portion of the first elongated portion being secured to the sail along a line spaced aft of the leading edge of the sail and running from head to foot,
a second elongated portion disposed on the other side of the sail and having a leading edge and a trailing edge,
the leading edge of the second elongated portion being secured to the sail along the leading edge of the sail,
the lateral extent of the second elongated portion being substantially greater than that of the first elongated portion,
the trailing edge of the second elongated portion being secured to the sail along a line spaced aft of the juncture between the trailing edge portion of the first elongated portion and the sail;
one of the elongated flexible fastener elements being secured to and extending along the trailing edge portion of the first elongated portion of said flexible sheet material;
the other of the elongated flexible fastener elements being secured to the second elongated portion of said flexible sheet material.

43. The combination defined in claim 42, wherein said other elongated flexible fastener element is spaced forwardly from the trailing edge of the second elongated portion of said flexible sheet material.

44. The combination defined in claim 43, wherein the combined lateral extent of the portion of the second elongated portion aft of said other elongated flexible fastener element and the portion of the sail between the trailing edge of the second elongated portion and the juncture between the sail and the trailing edge portion of the first elongated portion is smaller than the combined lateral extent of the first and second elongated portions forwardly of the elongated flexible fastener elements.

45. The combination defined in claim 42, wherein at least the portions of the first and second elongated portions of said flexible sheet material located forwardly of the elongated flexible fastener elements are of material resistant to ultra-violet light.

46. The combination defined in claim 16, wherein said flexible sheet material is a fore portion of the sail.

47. The combination defined in claim 46, wherein one of the elongated flexible fastener elements extends along and is secured to the sail adjacent the leading edge portion of the sail; and
the other of the elongated flexible fastener elements is secured to the sail along a line slanting from the leading edge at the head downwardly and aft to the foot.

48. The combination defined in claim 47, wherein the elongated flexible fastener elements are disposed on opposite sides of the sail.

49. The combination defined in claim 16, wherein
the sail includes a head portion which, though stiffer than the main portion of the sail, is adequately flexible to be foldable;
said flexible sheet material includes two head portions disposed each on a different side of the head portion of the sail and each having a leading edge and a trailing edge,
the leading edges of said two head portions each extending along and being secured to the leading edge portion of the head portion of the sail,
the trailing edges of said two head portions each extending along an aft portion of the head portion of the sail;
the two elongated flexible fastener elements each extending upwardly over a different one of the two head portions and being secured thereto.

50. The combination defined in claim 49, wherein
the trailing edges of the two head portions of said flexible sheet material cross the leech of the head portion of the sail and then extend upwardly in a location aft of the leech; and
the two elongated flexible fastener elements include upper end portions secured respectively to those trailing edge portions of the two head portions of said flexible sheet material which are aft of the leech.

51. The combination defined in claim 50, wherein
the extreme upper ends of the two elongated flexible fastener elements curve forwardly and are secured to the head of the sail.

52. The combination defined in claim 51, wherein
the sail includes a headboard comprising two headboard plates located each on a different side of the head of the sail; and
the extreme upper ends of the two elongated flexible fastener elements are clamped between the plates of the headboard.

53. The combination defined in claim 16, wherein said flexible sheet material comprises
two elongated portions of the same shape and dimensions and each having a leading edge and a trailing edge, the leading edges of said portions being secured together at the leading edge of the sail and the trailing edges being secured together and to the sail, said portions being free and unattached throughout their length between their leading and trailing edges;
one of the elongated flexible fastener elements being secured to and extending along one of said two elongated portions and exposed on the outer surface thereof;
the other of the elongated flexible fastener elements being secured to and extending along the other of said two elongated portions and exposed on the outer surface thereof.

54. A feeder for progressively furling a working sail from head to foot while the sail is aloft comprising, in combination
an intermediate portion having a face having a configuration and dimensions such as to be slidably engageable with the leech portion of the sail during furling;
two flexible arms each extending from a different side of the intermediate portion so as to be disposed each on a different side of the sail during furling,
the arms being of substantial length and adapted to be connected to furling line means by which the feeder can be pulled downwardly to traverse the aft portion of the sail from head to foot; and
fastener means secured to the intermediate portion and exposed for connection of an unfurling line to the furler.

55. A triangular working sail comprising, in combination
a primary sail body of generally triangular plan form,
one long side of the primary body constituting the leech of the sail,
the other long side of the primary body being spaced rearwardly of the leading edge of the sail;
a luff portion comprising
two portions of flexible sheet material each having a leading edge and a trailing edge, said two portions being of the same shape and dimensions,
the trailing edges of said two portions each being secured to said other long side of the primary body of the sail; and
a luff tape,
the leading edges of said two portions being secured to the luff tape,
said two portions being free and unattached throughout their length between the luff tape and said other long side of the primary body of the sail.

56. A feeder for progressively furling a working sail from head to foot while the sail is aloft, comprising, in combination
a substantially rigid feeder body having a trailing end and a portion of generally U-shaped transverse cross section spaced from the trailing end,
said portion of generally U-shaped transverse cross section constituting two arm portions adapted to lie each on a different side of the leech of a sail when the feeder is in operative position relative to the sail;
a separable fastener runner rigidly secured to the trailing end portion of the feeder body; and
two flexible unfurling line portions each attached to a different one of said arm portions.

57. The combination defined in claim 56, wherein the separable fastener runner is located on the side of the trailing end portion of the feeder body opposite said arm portions, and
the combination further comprises fastener means secured to the feeder body and exposed for connection to an unfurling line.

58. A feeder for progressively furling a working sail from head to foot while the sail is aloft, comprising in combination
a feeder body having
an intermediate portion of significant length and having a leading end and a trailing end,
two arm portions each extending from a different side of the intermediate portion,
the body presenting an inner face, to be engaged over the sail during furling, and an outer face, to be directed away from the sail during furling;
means located at the end of each arm portion, in a position which leads as the furler is pulled downwardly to furl the sail, for connecting furling line means to the feeder; and
attachment means secured to the intermediate portion in a location which trails as the furler is pulled downwardly to furl the sail and by which an unfurling line can be attached to the feeder.

59. The combination defined in claim 58, wherein
the feeder body is a laminated generally flexible body and the inner lamina thereof presents an uninterrupted low-friction surface as said inner face.

60. In a sail stowage bag, the combination of
a bag body of flexible sheet material comprising
a bottom wall, and
an annular side wall extending upwardly from the bottom wall and defining an open top;
annular reinforcing means connected to the top of the bag body and dimensioned to hold the top of the bag open;
flexible partition means comprising a single piece of sheet material extending from near the top of the bag body toward the bottom to divide the interior of the bag into two upright compartments open at the top;
two pairs of releasable fasteners,
the fasteners of each pair being secured to the bag adjacent the top of a different one of said compartments;
two additional fasteners secured to the side wall of the body adjacent the annular reinforcing means at points spaced across the open top of the body along a line generally transverse to the partition means; and
line means operatively connected to the top of the partition means and releasably attachable to one of said additional fasteners to draw the upper portion of the partition means across the open top of the corresponding one of the two compartments.

61. The combination defined in claim 60, wherein
the width of the upper portion of the flexible partition means is greater than the diameter of the open top of the bag body;
the line means is operatively connected to the central portion of the top of the partition means; and
the effective length of the line means is such as to hold the upper portion of the partition means taut when the line means is attached to one of said additional fasteners.

62. The combination defined in claim 61, wherein
the sheet material of the partition means is hemmed along its upper edge;
the line means comprises an elastic cord running through said hem of the partition means and secured to the annular reinforcing means adjacent the ends of the hem; and
the hem is interrupted adjacent its midpoint to allow the cord to be grasped and extended for attachment to one of said additional fasteners.

63. In a sail stowage bag, the combination of a bag body of flexible sheet material comprising
a bottom wall, and
an annular side wall extending upwardly from the bottom wall and defining an open top;
annular reinforcing means connected to the top of the bag body and dimensioned to hold the top of the bag open;
a flexible partition extending across the interior of the bag body from near the top toward the bottom to divide the interior of the bag into upright compartments open at the top;
two pairs of releasable fasteners,
the fasteners of each pair being secured to the bag adjacent the top of a different one of said compartments,
the fasteners of both pairs being located adjacent one edge of the partition; and
a cover hinged to the side wall of the bag body and constructed to close the open top of the bag body,
the cover having indicia which is exposed when the cover is closed, said indicia then indicating the location of said two pairs of releasable fasteners.

64. The method for furling a working sail while the sail is aloft, the sail being of flexible sail material, comprising
providing flexible sheet material extending along the sail from head to foot and located aft of the leading edge of the sail, said flexible sheet material being in addition to the sheet material of the sail and comprising
two elongated portions each having a leading edge and a trailing edge portion,
each of the two elongated portions being disposed on a different side of the sail and having its leading edge secure to the sail along the luff;
at least preliminarily furling the sail from leech to luff while the sail is aloft and the leading edge of the sail is attached to a support;
progressively forming said flexible sheet material into a tubular bag the length of which extends between the head and the foot of the sail and progressively disposing the sail in fully furled condition within the tubular bag as the bag is formed and while the leading edge of the sail remains attached to the support,
the step of progressively forming said flexible sheet material into a tubular bag being carried out by progressively bringing together the trailing edge portions of said two elongated portions; and
as the tubular bag is formed, progressively securing the bag against opening.

65. The method according to claim 64, wherein
the step of progressively securing the bag against opening is accomplished by releasably securing said trailing edge portions to each other as they are brought together.

66. The method for furling a working sail while the sail is aloft, the sail being of flexible sail material, comprising
providing flexible sheet material extending along the sail from head to foot and comprising
an elongated portion of flexible sheet material in addition to the sheet material of the sail and having a leading edge and a trailing edge,
the leading edge of the elongated portion being secured to the sail along the leading edge of the sail,
the trailing edge of the elongated portion being secured to the sail along a line extending from the head to the foot aft of the leading edge of the sail,
said elongated portion of flexible sheet material being free from attachment to the sail other than at the leading and trailing edges of said elongated portion;
at least preliminarily furling the sail from leech to luff while the sail is aloft and the leading edge of the sail is attached to a support;
progressively forming forwardly disposed portions of said elongated portion of flexible sheet material and the material of the sail into a tubular bag the length of which extends between the head and the foot of the sail and progressively disposing the sail in fully furled condition within the tubular bag as the bag is formed and while the leading edge of the sail remains attached to the support,
the step of progressively forming the tubular bag being carried out by progressively bringing together a linear portion of said elongated portion of flexible sheet material and a linear portion of the material of the sail, said linear portions extending from head to foot and being intermediate the leading edge of the sail and the trailing edge of said elongated portion, the step of progressively disposing the sail in fully furled condition within the tubular bag being carried out by progressively inserting forwardly into the space between the portions of the sail and said elongated portion which are forward of said linear portions both the portions of the sail and said elongated portion which are aft of said linear portions but forward of the trailing edge of said elongated portion and the portion of the sail aft of the trailing edge of said elongated portion; and as the tubular bag is formed, progressively securing the bag against opening.

67. The method according to claim 66, wherein the step of progressively securing the bag against opening is carried out by releasably securing said linear portions to each other as they are brought together.

68. The method for furling a working sail while the sail is aloft, the sail being of flexible sail material, comprising providing flexible sheet material extending along the sail from head to foot and comprising a first elongated portion of flexible sheet material having a leading edge and a trailing edge, said first elongated portion being disposed on one side of the sail and having its leading edge secured to the sail along the leading edge of the sail and its trailing edge secured to the sail along a line running from head to foot aft of the leading edge of the sail, a second elongated portion of flexible sheet material having a leading edge and a trailing edge, said second elongated portion being disposed on the other side of the sail and having its leading edge secured to the sail along the leading edge of the sail and its trailing edge secured to the sail along a line running from head to foot aft of the leading edge of the sail, said second elongated portion being substantially wider than said first elongated portion, whereby the trailing edge of said second elongated portion is secured to the sail in a location spaced a substantial distance aft of the trailing edge of said first elongated portion;

at least preliminarily furling the sail from leech to luff while the sail is aloft and the leading edge of the sail is attached to a support;

progressively forming said flexible sheet material into a tubular bag the length of which extends between the head and the foot of the sail and progressively disposing the sail in fully furled condition within the tubular bag as the bag is formed and while the leading edge of the sail remains attached to the support, the step of progressively forming said flexible sheet material into a tubular bag being carried out by progressively bringing together the trailing edge of said first elongated portion of flexible sheet material and a linear portion of said second elongated portion of flexible sheet material, said linear portion extending from head to foot and being located intermediate the leading and trailing edges of said second elongated portion; and as the tubular bag is formed, progressively securing the bag against opening.

69. The method according to claim 68, wherein the step of progressively securing the bag against opening is carried out by releasably securing the trailing edge of said first elongated portion to said linear portion of said second elongated portion.

70. The method for furling a working sail while the sail is aloft, the sail being of flexible sail material, comprising providing flexible sheet material extending along the sail from head to foot, located aft of the leading edge of the sail, and comprising two elongated portions of flexible sheet material of the same shape and dimensions and each having a leading edge and a trailing edge, the leading edges of said portions being secured to the luff tape and the trailing edges being secured together and to the sail, said portions being free and unattached throughout their length between their leading and trailing edges;

at least preliminarily furling the sail from leech to luff while the sail is aloft and the leading edge of the sail is attached to a support;

progressively forming said flexible sheet material into a tubular bag the length of which extends between the head and the foot of the sail and progressively disposing the sail in fully furled condition within the tubular bag as the bag is formed and while the leading edge of the sail remains attached to the support, the step of progressively forming said flexible sheet material into a tubular bag being carried out by progressively inserting trailing portions of said two elongated portions forwardly into the space between said two elongated portions, whereby a double-walled bag is formed; and as the tubular bag is formed, progressively securing the bag against opening.

71. The method according to claim 70, wherein the step of progressively securing the bag against opening is carried out by releasably securing together two linear portions of said two elongated portions, said linear portions extending from head to foot in locations disposed between the leading and trailing edges of said two elongated portions.

* * * * *